US010112411B2

(12) United States Patent
Aihara et al.

(10) Patent No.: US 10,112,411 B2
(45) Date of Patent: Oct. 30, 2018

(54) TRANSFER APPARATUS

(71) Applicants: Yuichi Aihara, Yamanashi-ken (JP); Naoki Shimizu, Yamanashi-ken (JP)

(72) Inventors: Yuichi Aihara, Yamanashi-ken (JP); Naoki Shimizu, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 2 days.

(21) Appl. No.: 14/719,679

(22) Filed: May 22, 2015

(65) Prior Publication Data

US 2015/0336396 A1 Nov. 26, 2015

(30) Foreign Application Priority Data

May 23, 2014 (JP) ..... 2014-106968

(51) Int. Cl.
*B41J 11/00* (2006.01)
*B41J 2/325* (2006.01)
(Continued)

(52) U.S. Cl.
CPC ..... *B41J 2/325* (2013.01); *B41J 11/0005* (2013.01); *B65H 15/00* (2013.01); *B65H 29/125* (2013.01);
(Continued)

(58) Field of Classification Search
CPC .... B41J 11/0005; B41J 11/0045; B41J 2/325; B65H 29/125; B65H 29/70; B65H 15/00;
(Continued)

(56) References Cited

U.S. PATENT DOCUMENTS

2008/0152795 A1* 6/2008 Ihara ..... B41M 5/38221 427/148
2010/0150635 A1* 6/2010 Tanaka ..... G03G 15/6576 399/406
(Continued)

FOREIGN PATENT DOCUMENTS

JP H09-025040 A 1/1997
JP 2002-316761 A 10/2002
(Continued)

OTHER PUBLICATIONS

Japan Patent Office, "Office Action for Japanese Patent Application No. 2014-106968," dated Jan. 30, 2018.

*Primary Examiner* — Yaovi M Ameh
(74) *Attorney, Agent, or Firm* — Manabu Kanesaka

(57) ABSTRACT

To provide a transfer apparatus correcting a curl of a card efficiently while preventing the card from deteriorating, a printing apparatus includes a transfer section transferring a transfer surface of a transfer film to the card, a rotating unit reversing the front side and back side of the card in two-sided transfer, a decurl mechanism correcting a curl of the card with the transfer surface transferred in the transfer section, and a control section controlling the decurl mechanism. The control section controls the decurl mechanism such that a correction amount for the card with the transfer surface transferred to one surface in two-sided transfer is smaller than a correction amount for the card in one-sided transfer, and that the total sum of correction amounts for respective surfaces of the card in two-sided transfer is smaller than the correction amount for the card in one-sided transfer.

14 Claims, 23 Drawing Sheets

(51) Int. Cl.
*B65H 29/70* (2006.01)
*B65H 15/00* (2006.01)
*B65H 29/12* (2006.01)

(52) U.S. Cl.
CPC ..... *B65H 29/70* (2013.01); *B65H 2301/132* (2013.01); *B65H 2301/51212* (2013.01); *B65H 2301/51256* (2013.01); *B65H 2403/512* (2013.01); *B65H 2404/1421* (2013.01); *B65H 2511/222* (2013.01); *B65H 2511/413* (2013.01); *B65H 2511/416* (2013.01); *B65H 2513/11* (2013.01); *B65H 2513/53* (2013.01); *B65H 2515/40* (2013.01); *B65H 2515/83* (2013.01); *B65H 2701/1914* (2013.01)

(58) Field of Classification Search
CPC ..... B65H 2511/416; B65H 2403/512; B65H 2301/132; B65H 2515/83; B65H 2515/40; B65H 2301/51212; B65H 2404/1421; B65H 2513/11; B65H 2513/53; B65H 2511/413; B65H 2301/51256; B65H 2511/222; B65H 2701/1914
See application file for complete search history.

(56) References Cited

U.S. PATENT DOCUMENTS

2010/0209167 A1* 8/2010 Kaechi ..... B41J 2/325 400/76
2010/0329718 A1* 12/2010 Isohara ..... G03G 15/20 399/68
2013/0195534 A1* 8/2013 Oohara ..... G03G 15/6576 399/406

FOREIGN PATENT DOCUMENTS

JP 2002-362755 A 12/2002
JP 2011-136783 A 7/2011

* cited by examiner

TRANSFER APPARATUS

TECHNICAL FIELD

The present invention relates to a transfer apparatus, and more particularly, to a transfer apparatus that transfers an image to a card-shaped recording medium.

BACKGROUND ART

Conventionally, a transfer apparatus, which transfers an image (mirror image) formed on a transfer film to a card using a heat roller (FIR), has been known widely. Generally, this type of transfer apparatus adopts a configuration in which the heat roller is pressed against a surface on the side opposite to a transfer surface of a transfer film and the transfer film and a card are concurrently transported (at the same velocity).

In such a transfer apparatus, by heat being applied to the card from the heat roller, materials (for example, PVC) of the card expand, and a curl occurs in the card by a force spread outward and an inclusion force due to the heat roller in peeling off the image from the transfer surface of the transfer film. Therefore, the transfer apparatus is provided with a decurl mechanism that corrects the curl of the card, and after transferring the image to the card, decurl processing to correct the curl of the card is performed using the decurl mechanism.

For example, Patent Document 1 discloses techniques for transporting the card to the decurl mechanism to halt at the center arrival time in performing decurl processing, pressing a decurl unit (pressing member) downward, and performing the decurl processing on the card for a time set by a user. In the techniques, as shown in FIG. 23A, by pressing the other surface (upper surface in the figure) side of the card with an image transferred to one surface (lower surface in the figure) side having a curl using the pressing member constituting the decurl mechanism for a predetermined time (A seconds) to correct (remove) the curl of the card, the card is rotated 180° (reverse the frontside and backside), and as shown in FIG. 23B, the pressing member presses one surface (upper surface in the figure) side of the card with the image transferred to the other surface (lower surface in the figure) side having the curl similarly for the predetermined time (A seconds) to correct the curl. In other words, in the techniques of Patent Document 1, both in the case of transferring an image to only one surface (FIG. 23A) and in the case of transferring images to both surfaces (see FIG. 23B), the curl of the card is corrected by pressing the card with the decurl unit for the same time (A seconds) to provide the card excellent in handling and appearance.

In addition, as techniques related to the present invention, Patent Document 2 discloses a two-sided recording apparatus to prevent a transfer failure such as a jam from occurring on a sheet. This apparatus is provided with a guide section which passes the sheet while curving and thereby changes a curl state of the sheet, and the curl state of the sheet is corrected by varying a time for which the sheet is passed through the guide section. The time for passing through the guide section is determined corresponding to a sheet size, sheet thickness, ambient temperature of the apparatus, humidity, optional setting, fusing temperature of a heat fusing section, and sheet temperature.

PRIOR ART DOCUMENT

Patent Document

[Patent Document 1] Japanese Patent Application Publication No. 2011-136783 (see Paragraphs [0032], and [0053]~[0055])

[Patent Document 2] Japanese Patent Application Publication No. H09-025040

DISCLOSURE OF INVENTION

Problems to be Solved by the Invention

In addition, in the techniques of Patent Document 1, it is not considered that a part of the curl of the card is cancelled in two-sided transfer, and the decurl processing has been performed on each of the frontside and backside (one surface and the other surface) of the card for the same time (A seconds). The respect that it is not considered that the curl of the card is cancelled on the frontside and backside is clearer by comparing with the case where the decurl processing is not performed (the decurl mechanism is not provided) as shown in FIGS. 23C to 23E.

FIG. 23C shows the case (decurl time 0 second) of not pressing, with a pressing member, the other surface (upper surface in the figure) side of the card with an image transferred to one surface (lower surface in the figure) side having a curl in the case of one-sided transfer and two-sided transfer, and the curl amount of the card is large. FIG. 23D shows a state in which the frontside and backside of the card with a large curl amount shown in FIG. 23C are reversed, an image is transferred to the other surface (lower surface in the figure) side with a heat roller HR, and a curl of the card is thereby formed in the opposite direction i.e. a state in which parts of curl amounts of the other surface and one surface sides of the card are canceled, and the curl amount is small, in the case of two-sided transfer. FIG. 23E shows the case (decurl time 0 second) of not pressing, with the pressing member, one surface (upper surface in the figure) side of the card with an image transferred to the other surface (lower surface in the figure) side having a small curl amount in the case of two-sided transfer.

As shown in FIG. 23D, when it is considered that a part of the curl amount of the card is cancelled in two-sided transfer, it is possible to grasp that the decurl processing has been performed on the other surface side (see FIG. 23A) and one surface side (see FIG. 23B) more than necessary in two-sided transfer. Further, in two-sided transfer, since the decurl processing is performed on both surfaces of the card in respective opposite directions, when the correction amount (particularly, pressing amount) in the card is large, there is the risk of inducing deterioration of the card and function deficiencies of the IC and the like incorporated into the card (see FIG. 23F).

In addition, Patent Document 2 discloses the techniques for varying the decurl time corresponding to materials of the sheet, environmental temperature and the like, but the techniques are not for the card, and the Document does not disclose that the correction amount is varied in one-sided transfer and two-sided transfer.

In view of the aforementioned matters, it is an object of the present invention to provide a transfer apparatus capable of correcting a curl of a card-shaped recording medium efficiently while preventing the recording medium from deteriorating.

Means for Solving the Problem

In order to attain the above-mentioned object, a first aspect of the present invention is a transfer apparatus provided with a transfer section that transfers a transfer surface of a transfer or protective film to one surface or both surfaces of a card-shaped recording medium, a reverse section that reverses the frontside and backside of the recording medium in two-sided transfer, a correction section that corrects a curl of the recording medium with the transfer surface transferred in the transfer section, and a control section that controls the correction section, and the control section is characterized by controlling the correction section so that a correction amount for the recording medium with the transfer surface transferred to one surface in two-sided transfer is smaller than a correction amount for the recording medium in one-sided transfer. In the first aspect, it is preferable that the control section controls the correction section so that the total sum of correction amounts for respective surfaces of the recording medium in two-sided transfer is smaller than the correction amount for the recording medium in one-sided transfer.

Further, in order to attain the above-mentioned object, a second aspect of the present invention is a transfer apparatus provided with a transfer section that transfers a transfer surface of a transfer or protective film to one surface or both surfaces of a card-shaped recording medium, a reverse section that reverses the frontside and backside of the recording medium in two-sided transfer, a correction section that corrects a curl of the recording medium with the transfer surface transferred in the transfer section, and a control section that controls the correction section, and the control section is characterized by controlling the correction section so that the correction section does not make a correction to the recording medium with the transfer surface transferred to one surface of both surfaces in two-sided transfer, while making a correction to only the recording medium with the transfer surface transferred to the other surface in two-sided transfer, and that a correction amount for the recording medium with the transfer surface transferred to the other surface in two-sided transfer is smaller than a correction amount for the recording medium in one-sided transfer.

In the first and second aspects, the correction section may correct a curl of the recording medium by pressing the surface on the side opposite to the surface of the recording medium with the transfer surface transferred in the transfer section, and the control section may change the correction amount by changing at least one of the time for the correction section to press the surface on the opposite side and a pressing amount against the surface on the opposite side by the correction section.

Further, in the first and second aspects, the apparatus is further provided with a first acquiring section that acquires type or material information of the recording medium, and the control section may determine the correction amount corresponding to the type or material information of the recording medium acquired in the first acquiring section. Furthermore, the apparatus is provided with an image formation section that forms an image on the transfer surface of the transfer film via an ink ribbon, and a second acquiring section that acquires image data of the image formed in the image formation section, and the control section may determine the correction amount corresponding to gray scale of the image data acquired in the second acquiring section. At this point, the apparatus is further provided with a third acquiring section that acquires type information of at least one of the ink ribbon and the transfer film, and the control section may determine the correction amount corresponding to the type information of at least one of the ink ribbon and the transfer film acquired in the third acquiring section. Still furthermore, the apparatus is provided with a detection section that detects an environmental temperature, and the control section may determine the correction amount corresponding to the environmental temperature detected in the detection section. Moreover, the transfer section has a heat fusing body to heat-fuse the transfer surface of the transfer or protective film to the recording medium, and the control section may determine the correction amount corresponding to at least one of a fusing temperature and a fusing velocity of the heat fusing body.

Advantageous Effect of the Invention

According to the first aspect of the present invention, the control section controls the correction section so that a correction amount for the recording medium with the transfer surface transferred to one surface in two-sided transfer is smaller than a correction amount for the recording medium in one-sided transfer, and it is thereby possible to obtain the effect of efficiently correcting a curl of the card-shaped recording medium, while enabling the recording medium to be prevented from deteriorating. According to the second aspect of the present invention, the control section controls the correction section so that the correction section does not make a correction to the recording medium with the transfer surface transferred to one surface of both surfaces in two-sided transfer, while making a correction to only the recording medium with the transfer surface transferred to the other surface in two-sided transfer, and that a correction amount for the recording medium with the transfer surface transferred to the other surface in two-sided transfer is smaller than a correction amount for the recording medium in one-sided transfer, and it is thereby possible to obtain the effect of correcting a curl of the card-shaped recording medium more efficiently, while enabling the recording medium to be prevented from deteriorating.

BRIEF DESCRIPTION OF DRAWINGS

FIG. 12A illustrates a state in which a pressing member is positioned in a retracted position separate from a support member, FIG. 12B illustrates a decurl state in which the pressing member moves to the support member, and FIG. 12C illustrates a state in which the pressing member is most pressed into the support member among decurl states;

FIG. 22A illustrates a decurl time for the other surface of a card with an image transferred to one surface in one-sided transfer and two-sided transfer, FIG. 22B illustrates a curl of the card in transferring an image to the other surface of the card with the image transferred to one surface in two-sided transfer, FIG. 22C illustrates a decurl time for one surface of the card with an image also transferred to the other surface of the card in two-sided transfer, FIG. 22D illustrates a pressing amount for the other surface of the card with the image transferred to one surface in two-sided transfer, and FIG. 22E illustrates a pressing amount for one surface of the card with the image also transferred to the other surface of the card in two-sided transfer; FIG. 23A illustrates conventional decurl operation for the other surface of a card with an image transferred to one surface in one-sided transfer and two-sided transfer, FIG. 23B illustrates conventional decurl operation for one surface of the card with an image also transferred to the other surface of the card in two-sided transfer, FIG. 23C illustrates a curl of a card in the case of not having a decurl mechanism in one-sided transfer and two-sided transfer, FIG. 23D illustrates a curl of the card in transferring an image also to the other surface of the card with the image transferred to one surface in two-sided transfer, FIG. 23E illustrates a curl of the card in the case of not having the decurl mechanism in two-sided transfer, and FIG. 23F illustrates deterioration of the card due to decurl operation.

BEST MODE FOR CARRYING OUT THE INVENTION

Described below are Embodiments in which the present invention is applied to a printing apparatus for printing and recording text and image on a card (card-shaped recording medium), while performing magnetic or electric information recording on the card.

<System Configuration>

Figure 1:
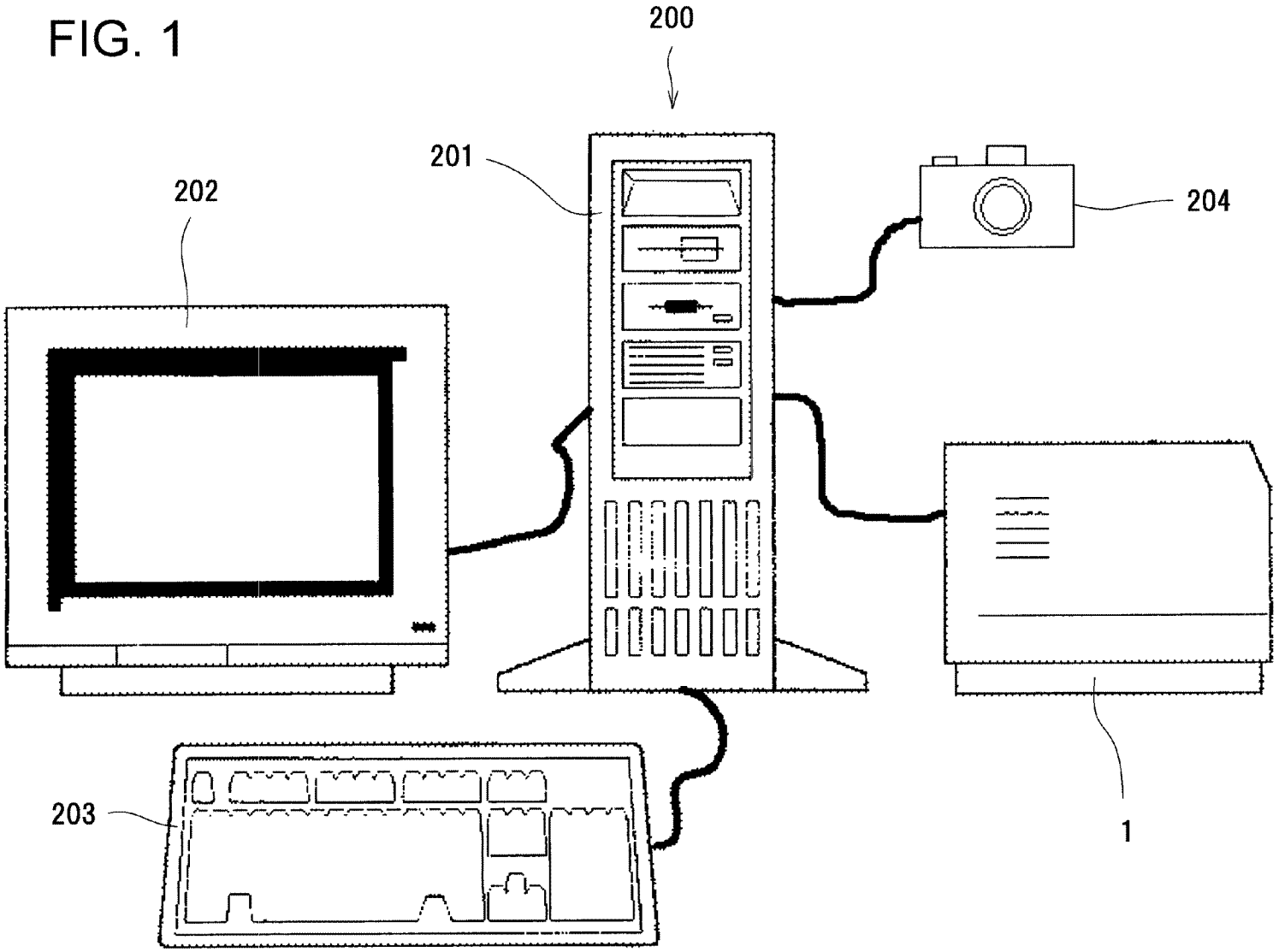
FIG. 1 is an outside view of a printing system including a printing apparatus of an Embodiment to which the present invention is applicable.
Figure 13:
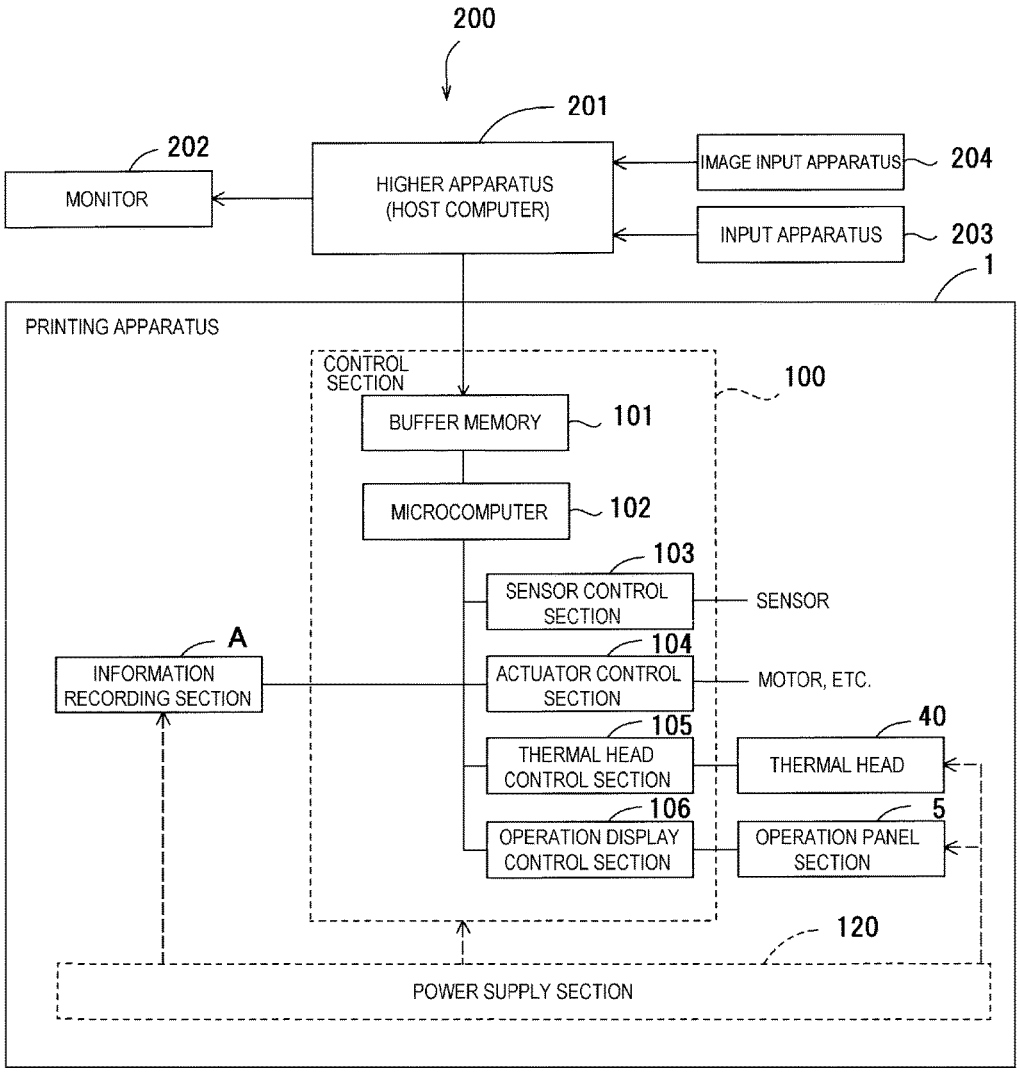
FIG. 13 is a block diagram illustrating a schematic configuration of a control section in the printing apparatus of the Embodiment.

As shown in FIGS. 1 and 13, a printing apparatus 1 of this Embodiment constitutes apart of a printing system 200. In other words, the printing system 200 is broadly comprised of a higher apparatus 201 (for example, host computer such as a personal computer), and the printing apparatus 1.

The printing apparatus 1 is connected to the higher apparatus 201 via an interface with the figure omitted, and the higher apparatus 201 is capable of transmitting image data, magnetic or electric recording data and the like to the printing apparatus 1 to indicate recording operation and the like. In addition, the printing apparatus 1 has an operation panel section (operation display section) 5 (see FIG. 13), and as well as recording operation indication from the higher apparatus 201, recording operation is also capable of being indicated from the operation panel section 5.

The higher apparatus 201 is connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printing Apparatus>

Figure 2:
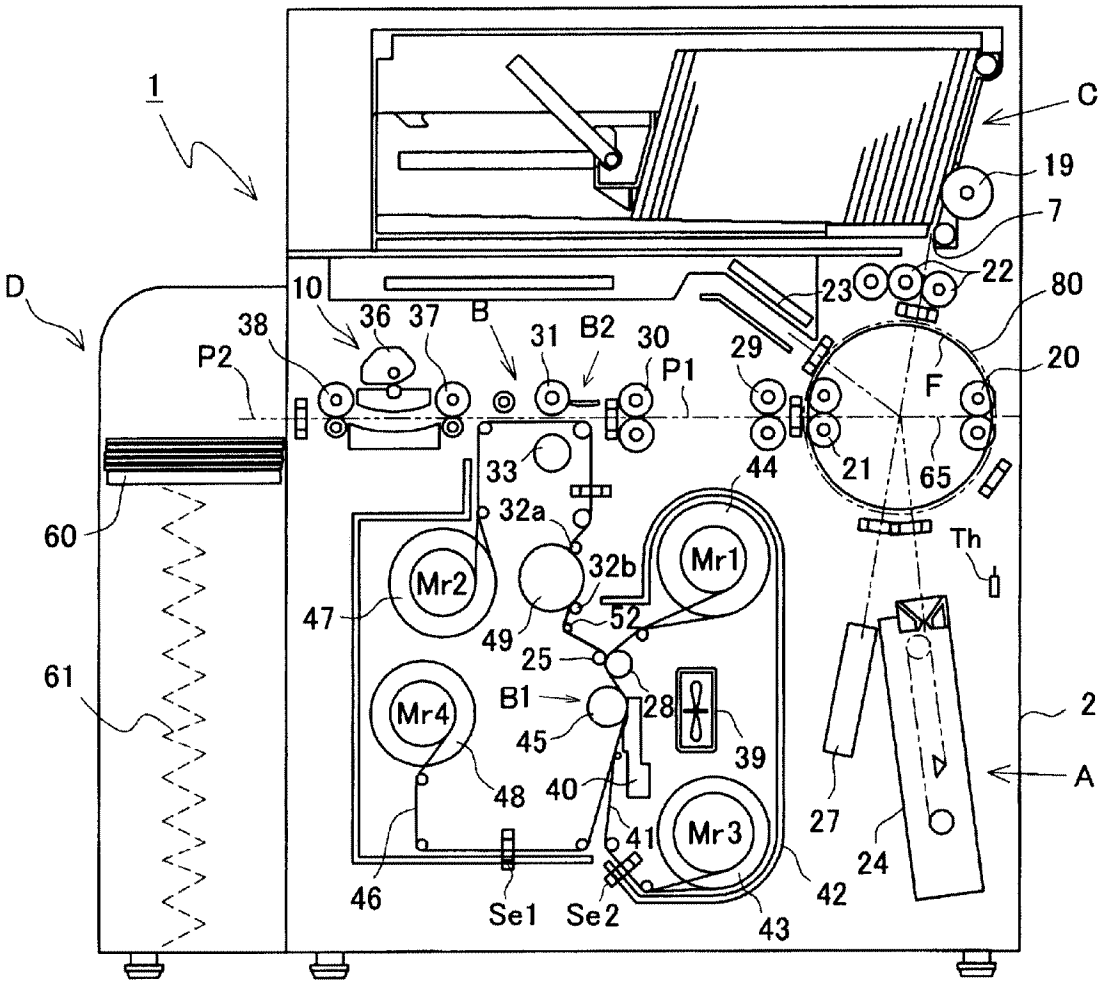
FIG. 2 is a schematic configuration view of the printing apparatus of the Embodiment.

As shown in FIG. 2, the printing apparatus 1 has a housing 2, and in the housing 2 are provided an information recording section A, printing section B, media storage section C, storage section D and rotating unit F.

(Information Recording Section)

The information recording section A is comprised of a magnetic recording section 24, non-contact type IC recording section 23, and contact type IC recording section 27.

(Media Storage Section)

The media storage section C aligns a plurality of cards in a standing posture to store, is provided at its front end with a separation opening 7, feeds and supplies sequentially starting with the card in the front row with a pickup roller 19.

(Rotating Unit)

The fed blank card is sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

In the outer region of the rotating reverse unit F are disposed the above-mentioned magnetic recording section 24, non-contact type IC recording section 23, and contact type IC recording section 27. Then, the roller pairs 20, 21 form a medium transport path 65 for transporting the card toward one of the information recording sections 23, 24 and 27, and data is magnetically or electrically written on the card in the recording sections. In addition, in the vicinity of the rotating unit F is disposed a temperature sensor Th such as a thermistor that detects an environmental temperature (ambient temperature).

(Printing Section)

The printing section B is to form an image such as a photograph of face and text data on the frontside and backside of the card, and a medium transport path P1 for carrying the card is provided on an extension of the medium transport path 65. Further, in the medium transport path P1 are disposed transport rollers 29, 30 that transport the card, and the rollers are coupled to a transport motor not shown.

The printing section B has a film-shaped medium transport mechanism, and is provided with an image formation section B1 that forms an image, with a thermal head 40, on a transfer film 46 transported with the transport mechanism, and a transfer section B2 that subsequently transfers the image formed on the transfer film 46 to the surface of the card on the medium transport path P1 with a heat roller 33.

On the downstream side of the printing section B is provided a medium transport path P2 for carrying the printed card to a storage stacker 60 on an extension of the medium transport path P1. In the medium transport path P2 are disposed transport roller pairs 37, 38 that transport the card, and the rollers are coupled to a transport motor not shown.

A decurl mechanism 10 is disposed in between the transport roller pair 37 and the transport roller pair 38, presses the center portion of the card of which opposite end portions are nipped between the transport roller pairs 37, 38, and thereby corrects a curl generated by thermal transfer with the heat roller 33. The decurl mechanism 10 is configured to be able to proceed and retract in the vertical direction as viewed in FIG. 2 by a configuration including an eccentric cam, and details thereof will be described later.

(Storage Section)

The storage section D is configured to store cards sent from the printing section B in the storage stacker 60. The storage stacker 60 is configured to shift downward in FIG. 2 with an up-and-down mechanism 61.

(Details of the Printing Section)

Next, the printing section B in the entire configuration of the above-mentioned printing apparatus 1 will be further described specifically.

The transfer film 46 has the shape of a band having a width slightly larger than the width direction of the card, and is formed by layering, from above, an ink reception layer that receives ink of an ink ribbon 41, a transparent protective layer that protects the surface of the ink reception layer, a peeling layer to promote integral peeling of the ink reception layer and protective layer by heat, and a substrate (base film) in this order.

The transfer film 46 is wound up or fed by a wind-up roll or feed roll that rotates inside a transfer film cassette by driving of motor Mr2 or Mr4, respectively. In other words, in the transfer film cassette, a wind-up spool 47 is disposed in the center of the wind-up roll, a supply spool 48 is disposed in the center of the feed roll, a rotation drive force of the motor Mr2 is transferred to the wind-up spool 47 via a gear not shown, and a rotation derive force of the motor Mr4 is transferred to the supply spool 48 via a gear not shown. A film transport roller 49 is a main drive roller to carry the transfer film 46, and by controlling driving of the roller 49, transport amount and transport halt position of the transfer film 46 are determined. The film transport roller 49 is coupled to a stepping motor not shown. The motors Mr2 and Mr4 are driven also in driving the film transport roller 49, are to wind the transfer film 46 fed from one of the wind-up spool 47 and supply spool 48 by the other one, and are not driven as main transport of the transfer film 46. In addition, forward-backward rotatable DC motors are used for the motors Mr2 and Mr4.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

The ink ribbon 41 is stored in an ink ribbon cassette 42 in a state in which the ribbon is laid between a supply spool 43 for supplying the ink ribbon 41 and a wind-up spool 44 for winding up the ink ribbon 41, the wind-up spool 44 rotates by a drive force of a motor Mr1, and the supply spool 43 rotates by a drive force of a motor Mr3. Forward-backward rotatable DC motors are used for the motors Mr1 and Mr3. Further, between the motors Mr1 and Mr3 is disposed a temperature sensor Th such as a thermistor that measures ambient temperatures of the motors Mr1 and Mr3.

The ink ribbon 41 is configured by repeating color ribbon panels of Y (Yellow), M (Magenta), and C (Cyan) and a Bk (Black) ribbon panel in the longitudinal direction in a face sequential manner. Further, an empty mark indicative of a use limit of the ink ribbon 41 is attached to an end portion of the ink ribbon 41. "Se2" shown in FIG. 2 denotes a transmission sensor to detect the empty mark.

A platen roller 45 and thermal head 40 form the image formation section B1, and the thermal head 40 is disposed in a position opposed to the platen roller 45. The thermal head 40 has a plurality of heating elements lined in the main scanning direction, these heating elements are selectively heated and controlled by a head control IC (not shown) according to printing data, and an image is printed on the transfer film 46 via the ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the ink ribbon cassette 42, the peeling roller 25 comes into contact with the peeling member 28 in printing, and the roller 25 and member 28 nip the transfer film 46 and ink ribbon 41 to peel. Then, the peeled ink ribbon 41 is wound around the wind-up spool 44 by the drive force of the motor Mr1, and the transfer film 46 is transported to the transfer section B2 having the platen roller 31 and heat roller 33 by the film transport roller 49.

In the transfer section B2, the transfer film 46 is nipped together with the card by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
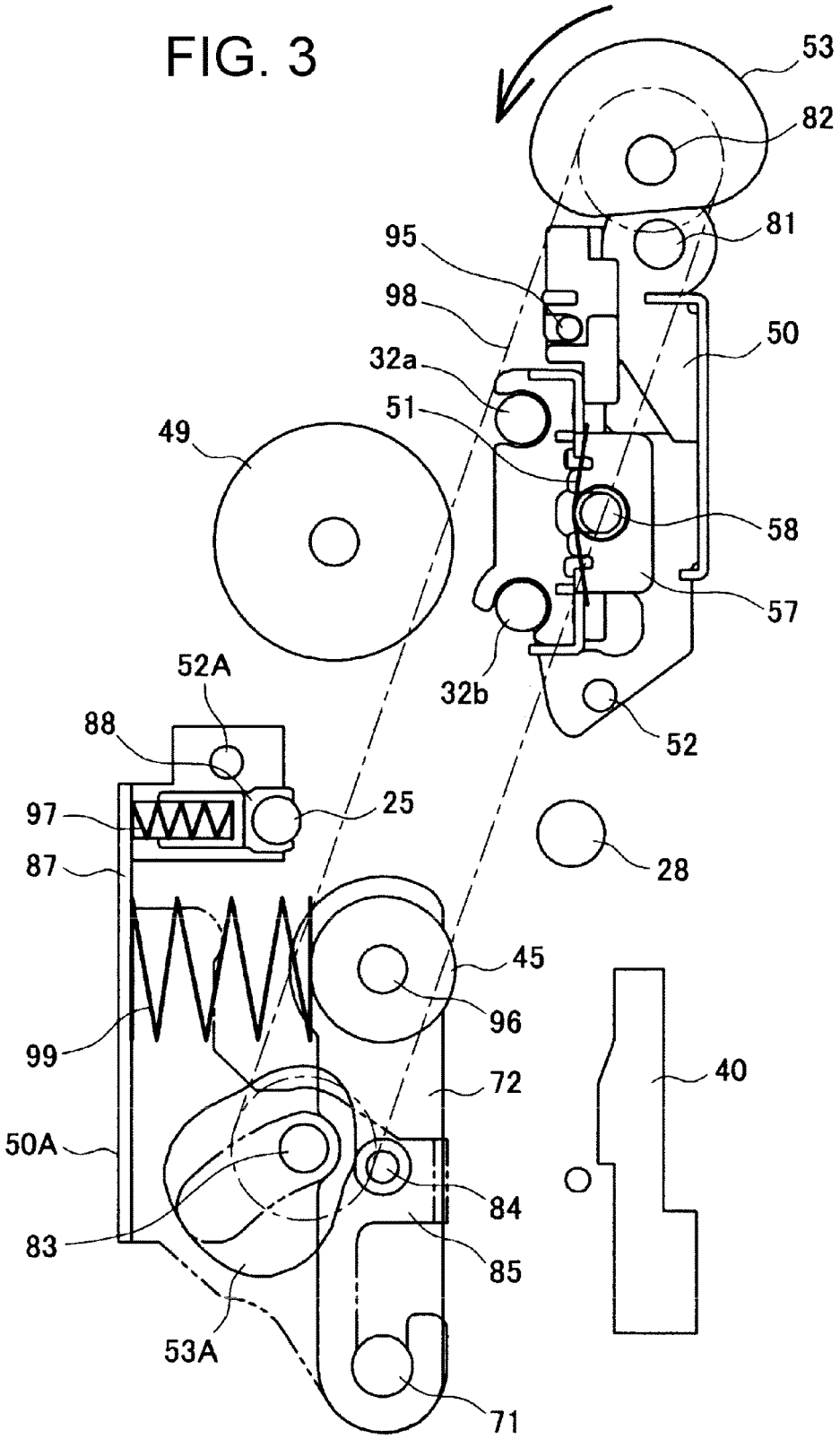
FIG. 3 is an explanatory view of a control state by a cam in a waiting position in which pinch rollers and film transport roller are separated from each other, and a platen roller and thermal head are separated from each other.
Figure 4:
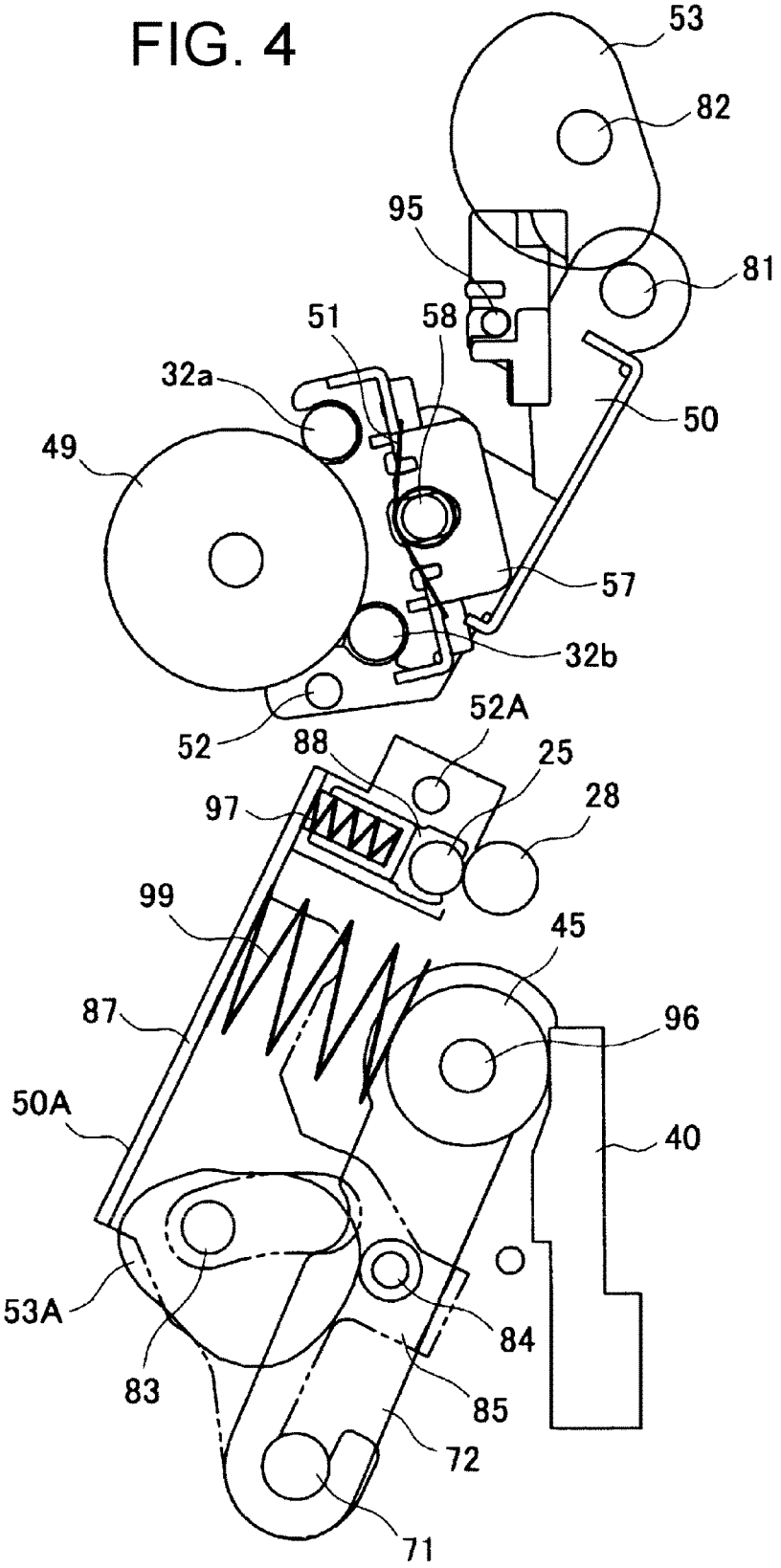
FIG. 4 is an explanatory view of a control state by the cam in a printing position in which the pinch rollers and film transport roller are brought into contact with each other, and the platen roller and thermal head are brought into contact with each other.
Figure 5:
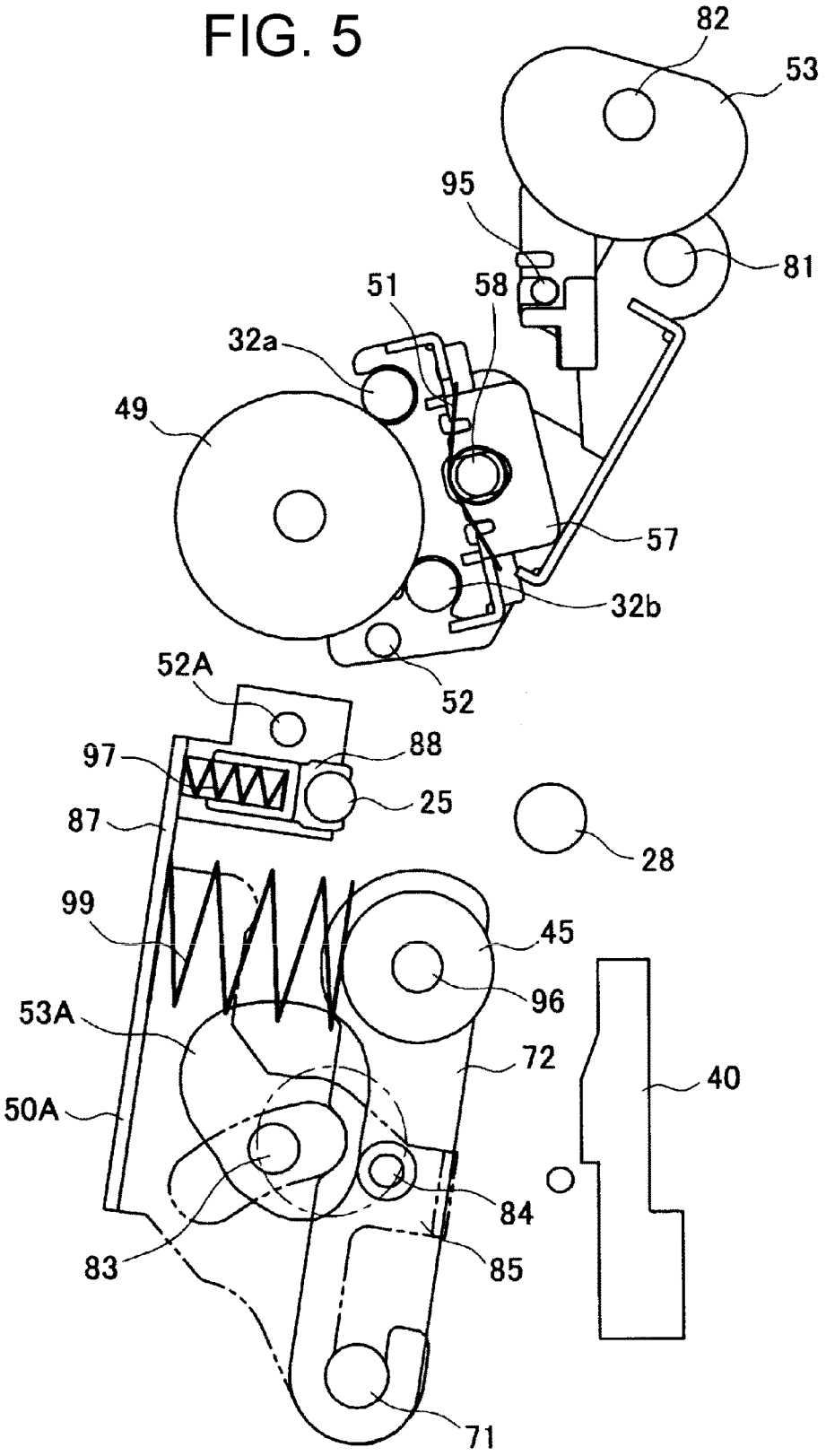
FIG. 5 is an explanatory view of a control state by the cam in a transport position in which the pinch rollers and film transport roller are brought into contact with each other, and the platen roller and thermal head are brought into contact with each other.
Figure 10:
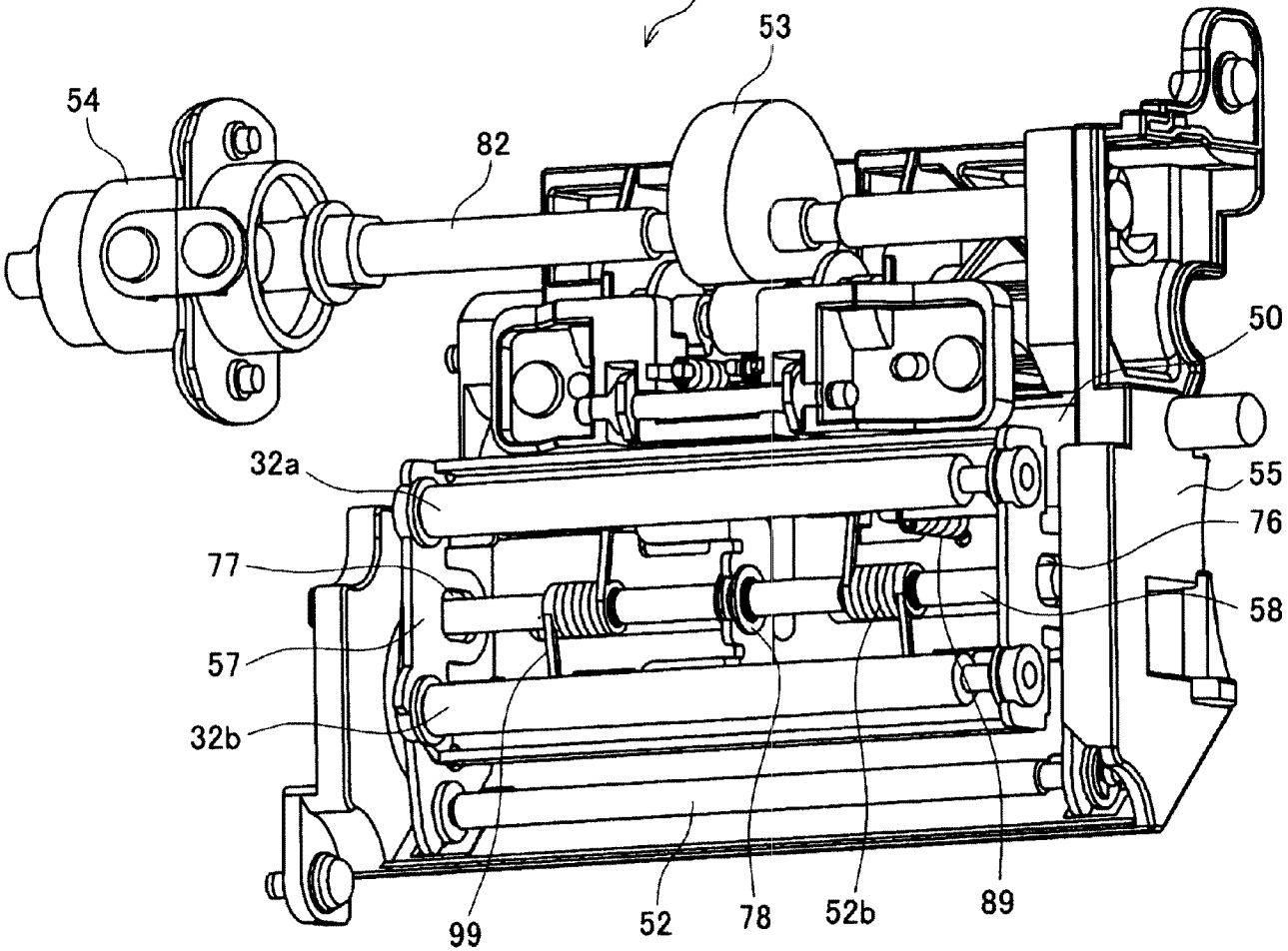
FIG. 10 is an outside view showing a configuration of a second unit integrated to incorporate the pinch rollers and their peripheral parts into the printing apparatus.

The configuration of the image formation section B1 will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 formed in the pinch roller support member 57, and is at its center portion fixed to a fix portion 78 of a bracket 50. Further, the long holes 76, 77 are provided with spaces in the horizontal direction and vertical direction with respect to the support shaft 58. By this means, it is made possible to adjust the pinch rollers 32*a*, 32*b* with respect to the film transport roller 49, described later.

Spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

The bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis rotating by drive force of a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are formed on the opposite sides of the pinch roller support member 57 and the support shaft 58 is fixed to the fix portion 78, it is possible to adjust the pinch roller support member 57 in three directions, and the transfer film 46 is transported in a correct posture by rotation of the film transport roller 49 without causing skew. In addition, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Furthermore, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
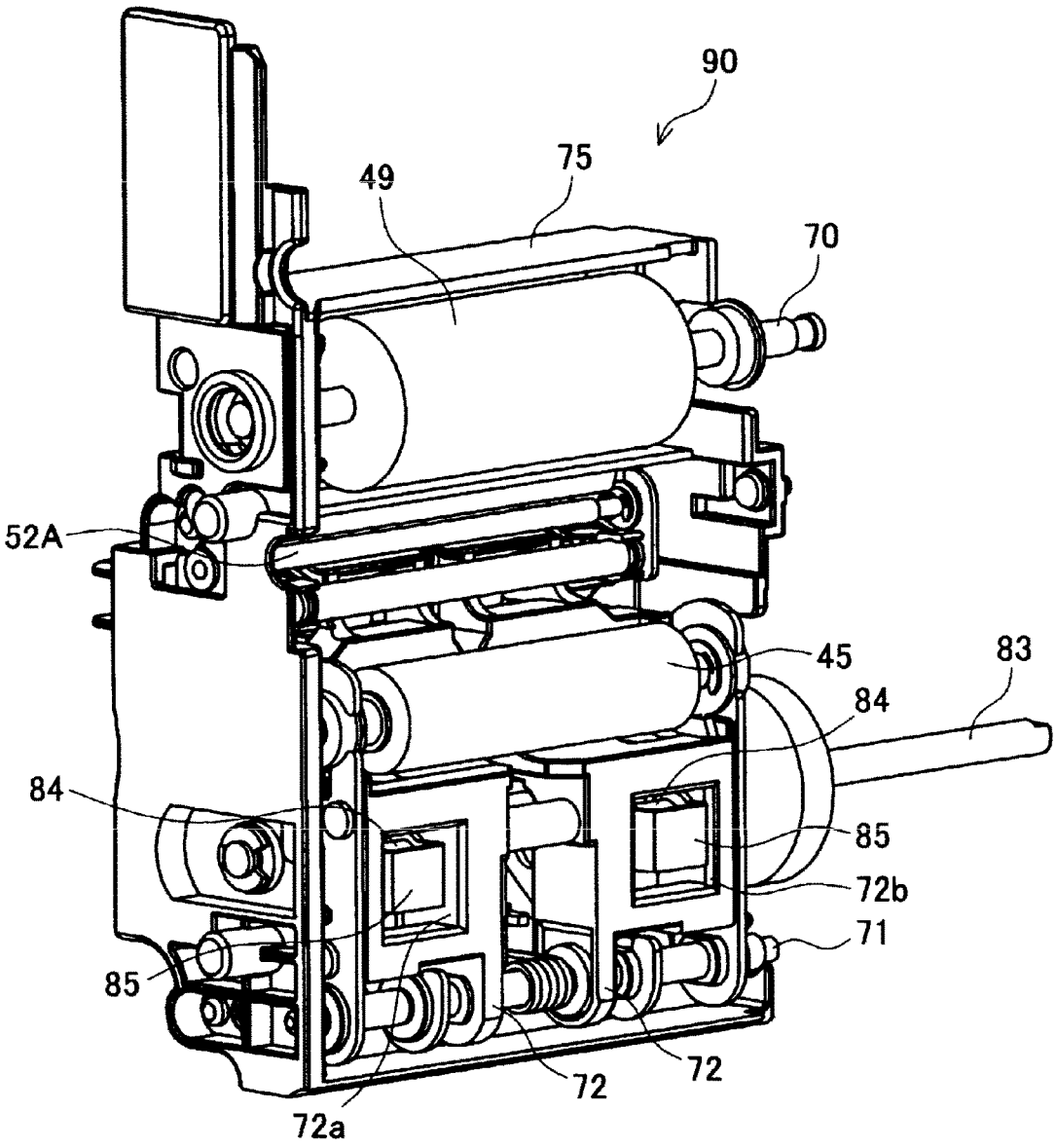
FIG. 9 is an outside view showing a configuration of a first unit integrated to incorporate the film transport roller, platen roller and their peripheral parts into the printing apparatus.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A has a substrate 87, and cam receiver support portion 85 formed by bending the substrate 87 in the direction of the platen support member 72, and the cam receiver support portion 85 holds a cam receiver 84. A cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and platen support members 72, and it is thereby possible to store a platen shift unit within the distance between the bracket 50A and platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Therefore, when the transfer film 46 is transported by the film transport roller 49, the skew is prevented, and it is possible to perform image formation on the transfer film 46 by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by same drive motor 54 with a belt 98 (see FIG. 3) laid therebetween.

Figure 6:
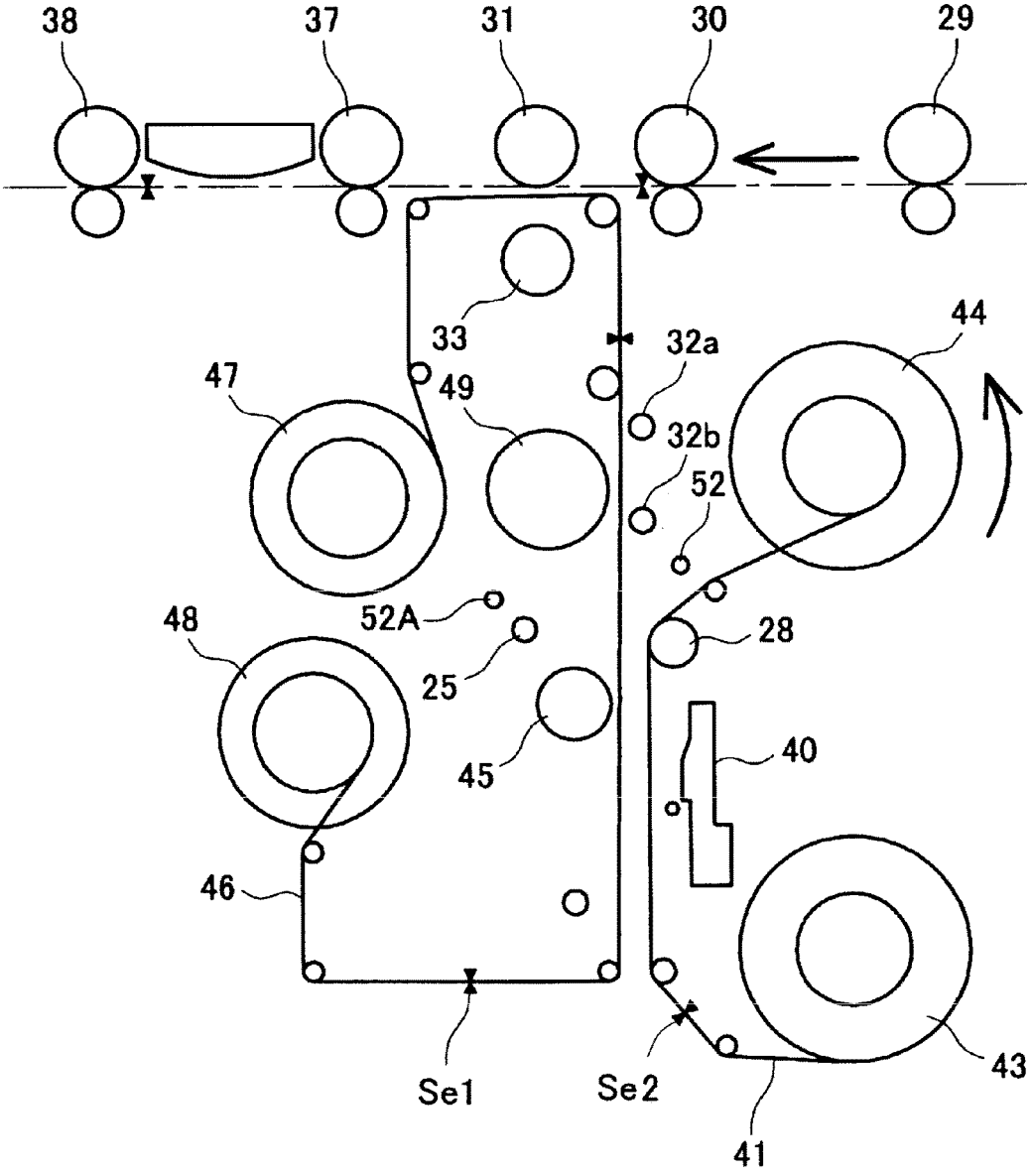
FIG. 6 is an operation explanatory view to explain the state of the waiting position in the printing apparatus.

When the printing section B is in a waiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either. In other words, in the waiting position, the platen roller 45 and thermal head 40 are positioned in separate positions in which the roller 45 and head 40 are separate.

Figure 7:
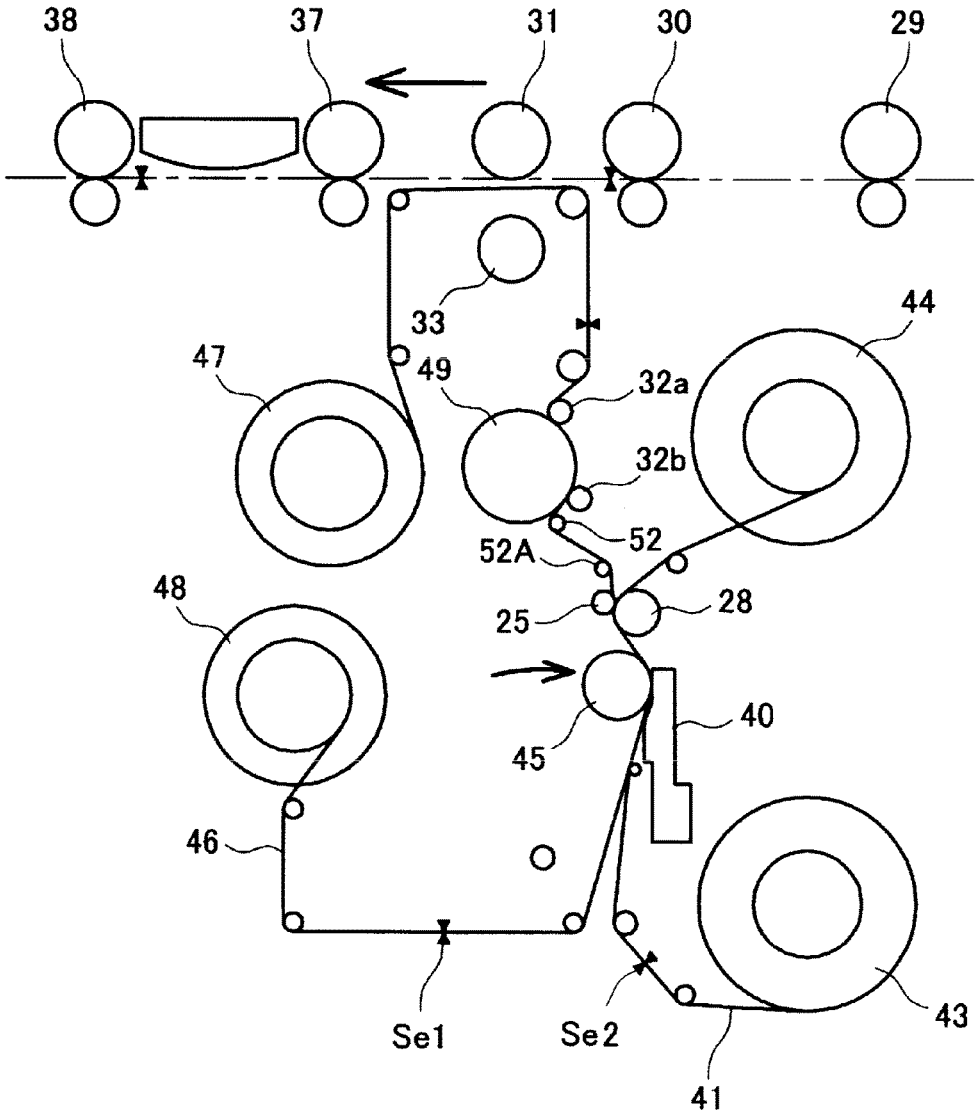
FIG. 7 is an operation explanatory view to explain the state of the transport position in the printing apparatus.

Then, when the cam 53 and cam 53A are rotated in conjunction with each other and are in the state as shown in FIG. 4, the printing section B shifts to a printing position as shown in FIG. 7. At this point, the pinch rollers 32*a*, 32*b* first wind the transfer film 46 around the film transport roller 49, and concurrently, the tension receiving member 52 comes into contact with the transfer film 46. Subsequently, the platen roller 45 comes into press-contact with the thermal head 40. In this printing position, the platen roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mr1 and transported in the same direction. During this transport, a positioning mark provided in the transfer film 46 passes through a sensor Se1 and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is thereby possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of a printing region to undergo printing is detected by an encoder (not shown) provided in the film transport roller 49, rotation of the film transport roller 49 is halted corresponding to detection, and at the same time, winding by the wind-up spool 44 by operation of the motor Mr1 is also halted. By this means, finished is printing with the ink of the first ink panel on the printing region of the transfer film 46.

Figure 8:
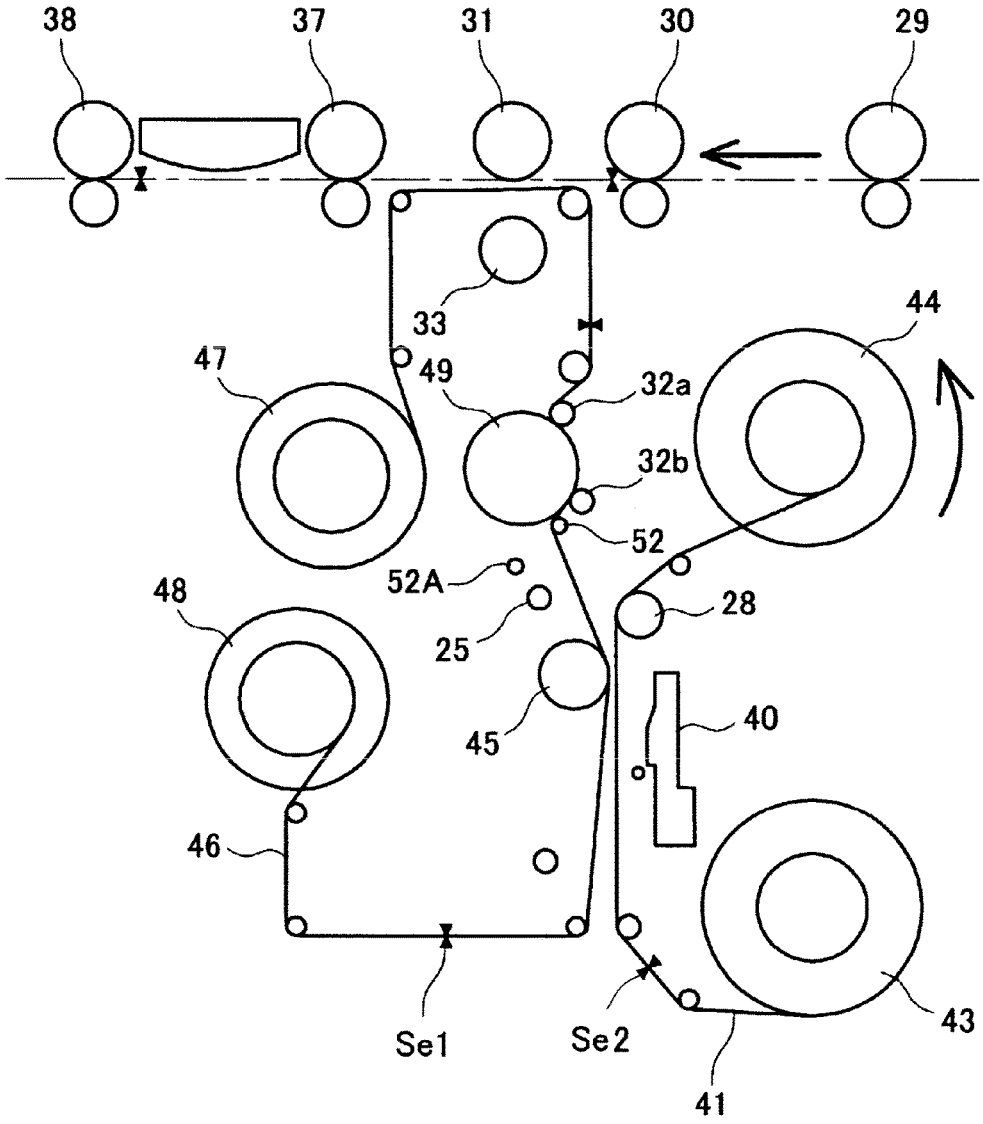
FIG. 8 is an operation explanatory view to explain the state of the printing position in the printing apparatus.

Next, when the cam 53 and cam 53A are further rotated in conjunction with each other and are in the state as shown in FIG. 5, the printing section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to an initial position by rotation in the backward direction of the film transport roller 49. Also at this point, the shift amount of the transfer film 46 is controlled by rotation of the film transport roller 49, and the transfer film 46 is transported backward corresponding to the length in the transport direction of the printing region subjected to printing. In addition, the ink ribbon 41 is also rewound a predetermined amount with the motor Mr3, and the ink panel of the ink to print next waits in the initial position (feeding position).

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 corresponding to the length of the printing region, and printing with the ink of the next ink panel is performed with the thermal head 40.

Thus, the operation in the printing position and transport position is repeated until printing with ink of all or predetermined ink panel is finished. Then, when printing with the thermal head 40 is finished, the image-formed region of the transfer film 46 is transported to the heat roller 33, and at this point, the cam 53 and cam 53A shift to the state as shown in FIG. 3, and release press-contact with the transfer film 46. Subsequently, transfer to the card is performed while transporting the transfer film 46 by driving of the wind-up spool 47.

Such a printing section B is divided into three units 90, 91, and 92.

As shown in FIG. 9, in the first unit 90, a unit frame body 75 is installed with a drive shaft 70 that rotates by driving of the motor 54 (see FIG. 10), and the drive shaft 70 is inserted in the film transport roller 49. Below the film transfer roller 49 are disposed the bracket 50A and a pair of platen support members 72, and these members are supported rotatably by the shaft 71 laid between opposite side plates of the unit frame body 75.

In FIG. 9, a pair of cam receiver support portions 85 that are apart of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the camshaft 83 inserted in the unit frame body 75. The camshaft 83 is laid between opposite side plates of the unit frame body 75.

Figure 11:
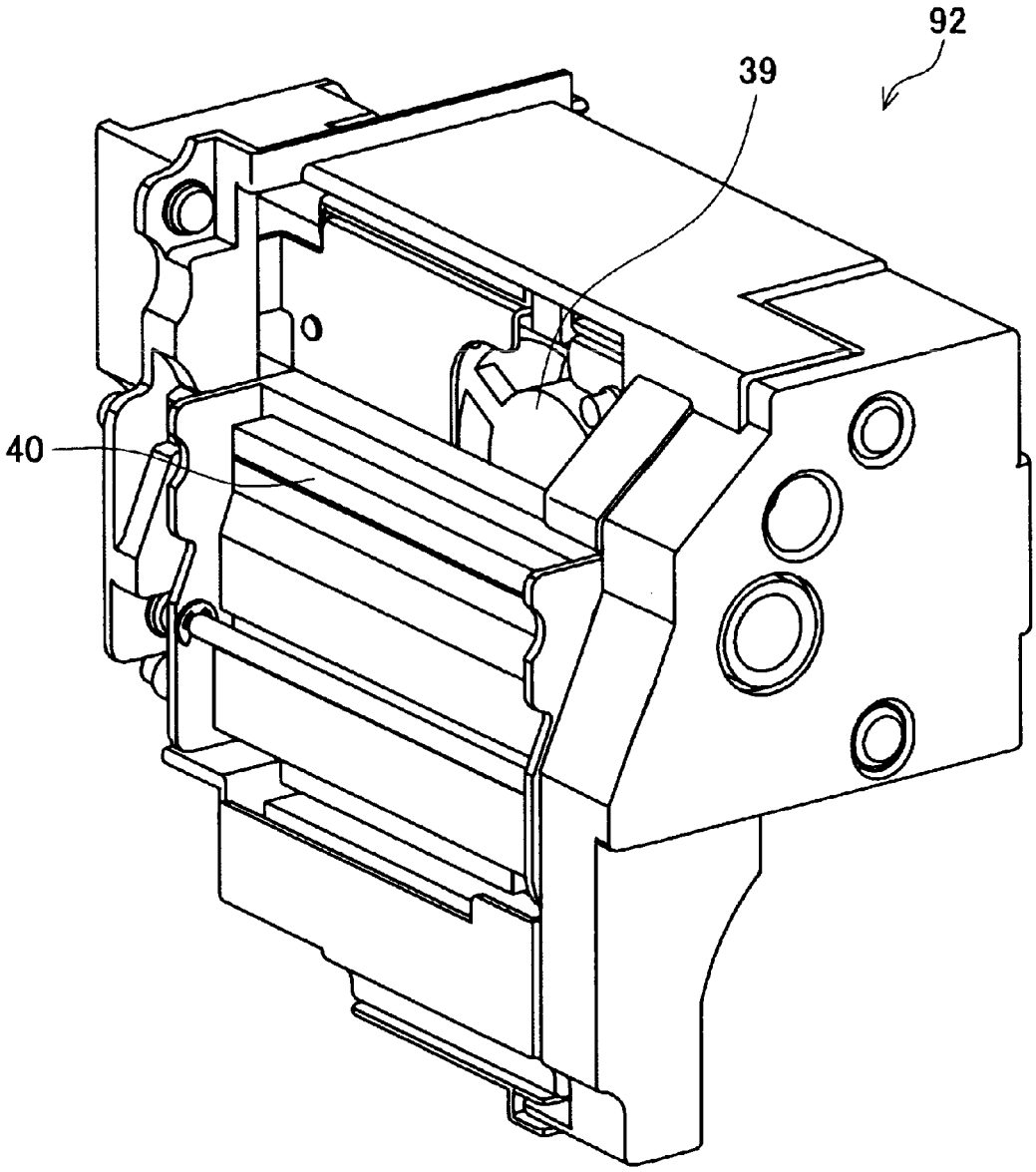
FIG. 11 is an outside view of a third unit integrated to incorporate the thermal head into the printing apparatus.

The above-mentioned thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 49 required to transport the transfer film with accuracy and the transfer position regulation portion by the platen roller 45 are included in the same unit, and therefore, the need is eliminated for position adjustments between both portions.

As shown in FIG. 10, in the second unit 91, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. In the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printing apparatus 1.

The second unit 91 holds the pinch rollers 32*a*, 32*b*, and tension receiving member 52 varying in position corresponding to printing operation in the bracket 50A, shifts the pinch rollers 32*a*, 32*b* and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 91 and third unit 92 out of the main body of the printing apparatus 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support member 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printing apparatus and adjustments in maintenance with ease and accuracy. Moreover, by integrating, it is possible to perform removal from the apparatus with ease, and the handleability as the printing apparatus is improved.

(Decurl Mechanism Details)

Details of the above-mentioned decurl mechanism 10 will be described next. As shown in FIG. 12, the decurl mechanism 10 has an eccentric cam 36, a pressing member 34 having a convex curved surface, and a support member 35 having a concavo curved surface associated with the curved surface of the pressing member 34 and is comprised thereof.

Figure 12A:
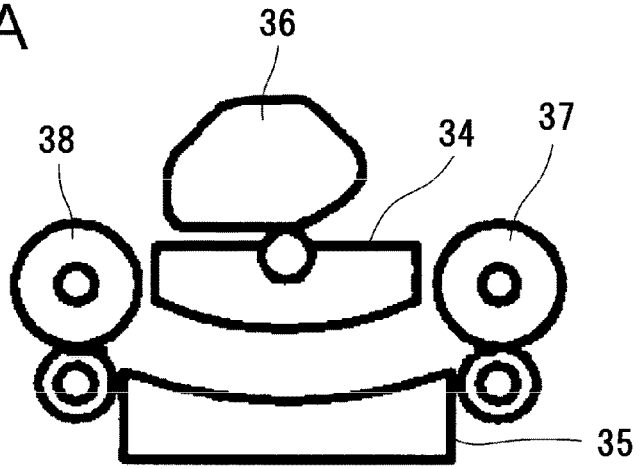
FIGS. 12A to 12C contain explanatory views illustrating decurl operation of a decurl mechanism of the printing apparatus of the Embodiment, where

As shown in FIG. 12A, at the non-operation time of the decurl mechanism 10, the pressing member 34 is positioned in a retracted position, and the pressing member 34 and support member 35 are disposed while being separated from each other so as to face via the medium transport path P2 (also see FIG. 2). In the pressing member 34, a roller is fixed to the center portion on the surface on the side opposite to the convex curved surface, and the roller is brought into contact with the periphery of the eccentric cam 36. A rotation drive force is transferred to the shaft (also see FIG. 2) of the eccentric cam 36 from a motor not shown via a plurality of gears (not shown in the figure).

Figure 12B:
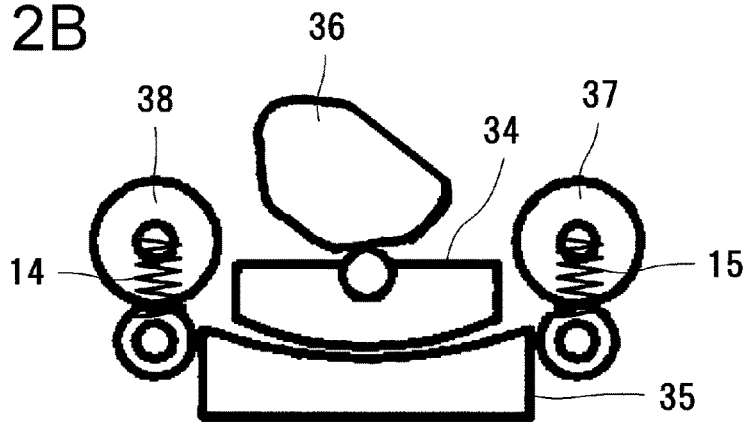

With respect to the card of which opposite end portions are nipped by the transport roller pairs 37, 38, by transferring the rotation drive force to the shaft of the eccentric cam 36 from the motor not shown to rotate the eccentric cam 36, as shown in FIG. 12B, the pressing member 34 crosses the medium transport path P2 to move to the support member 35 side. Accordingly, in this Embodiment, the card is nipped between the concavo curved surface of the support member 35 and the convex curved surface of the pressing member 34, and by applying a curl opposite to the curl of the card from the pressing member 34 and support member 35, is corrected.

Figure 12C:
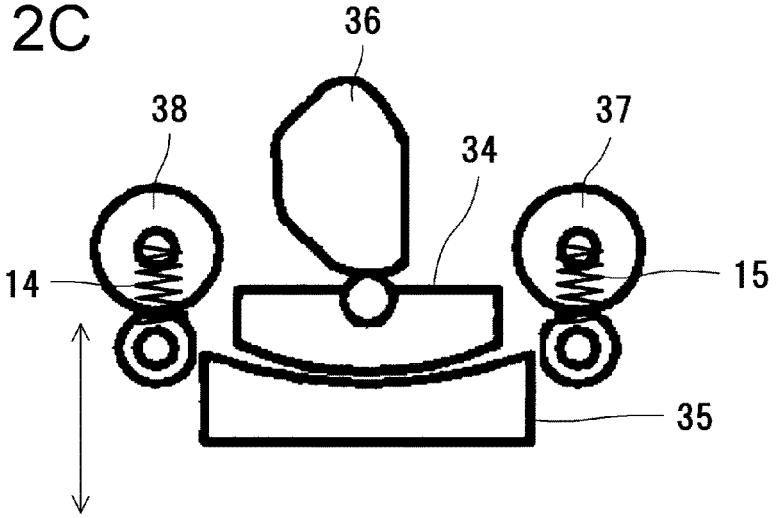

FIG. 12C illustrates a state in which the pressing member 34 is most pressed into the support member 35 in the decurl state as shown in FIG. 12B. The support member 35 and driven rollers (lower rollers in FIG. 12C) respectively constituting the transport roller pairs 37, 38 are provided slidably in the direction (vertical direction in FIG. 12C) crossing the medium transport path P2 as shown by the arrow in FIG.

12C, and are biased to the pressing member 34 side by springs 14 and 15. In addition, the support member 35 is fixed to bearings on the driven-roller side of the transport roller pairs 37, 38.

Described next is control and electric system of the printing apparatus 1. As shown in FIG. 13, the printing apparatus 1 has a control section 100 that performs operation control of the entire printing apparatus 1, and a power supply section 120 that transforms utility AC power supply into DC power supply that enables each mechanism section, control section and the like to be driven and actuated.

<Control Section>

As shown in FIG. 13, the control section 100 is provided with a microcomputer 102 that performs entire control processing of the printing apparatus 1. The microcomputer 102 is comprised of a CPU that operates at fast clock as the central processing unit, ROM in which are stored programs and program data of the printing apparatus 1, RAM that works as a work area of the CPU, and internal buses that connect the components.

The microcomputer 102 is connected to external buses. The external bus is connected to an interface, not shown, to communicate with the higher apparatus 201, and buffer memory 101 to temporarily store printing data to print on the card, recording data to magnetically or electrically record in a magnetic stripe or stored IC of the card, and the like.

Further, the external bus is connected to a sensor control section 103 that controls signals from various sensors, an actuator control section 104 that controls motor drivers and the like for outputting drive pulses and drive power to respective motors, a thermal head control section 105 to control thermal energy to heating elements constituting the thermal head 40, an operation display control section 106 to control the operation panel section 5, and the above-mentioned information recording section A.

(Power Supply Section)

The power supply section 120 supplies operation/drive power to the control section 100, thermal head 40, heat roller 33, operation panel section 5, information recording section A and the like.

<Decurl Processing>

Next, referring to FIG. 22, described is decurl processing (operation) by the decurl mechanism 10 of the printing apparatus 1 of this Embodiment. In addition, generally, two-sided transfer (two-sided printing) is often performed on the card, and therefore, the following description will be given with particular emphasis on the case of two-sided transfer.

Figure 22A:
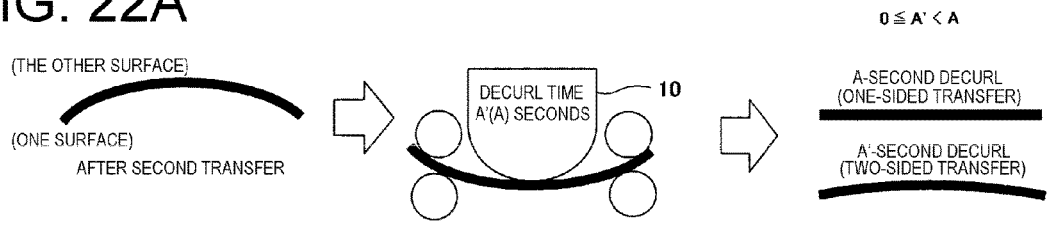
FIGS. 22A to 22E contain explanatory views schematically illustrating decurl operation by the decurl mechanism of the printing apparatus of the Embodiment, where
Figure 22B:
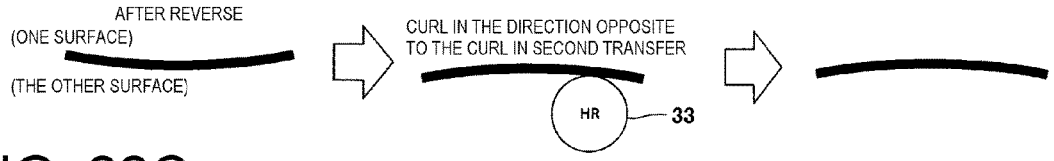
Figure 22C:
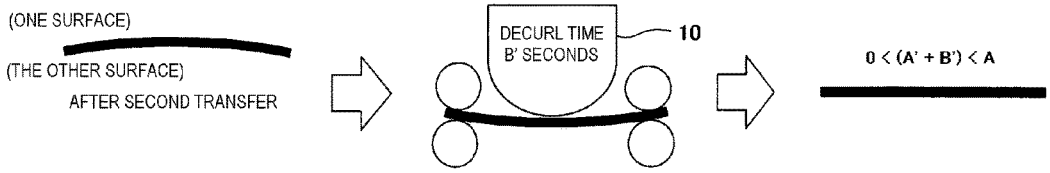

FIG. 22A schematically shows a time (decurl time) in the case where the decurl mechanism 10 performs decurl processing on the other surface (upper surface in the figure) side of a card with an image transferred to one surface (lower surface in the figure, e.g. frontside) side having a curl. Herein, the decurl time originally refers to a time between a start time and an end time with the start time set at the time the lowest end of the convex curved surface of the pressing member 34 contacts (comes into contact with) the card and the end time set at the time the contact with the card is released, however, since a state of a curl is various corresponding to the type of card and the like to vary the start time, in this Embodiment, the start time is the time the lowest end of the convex curved surface of the pressing member 34 comes into contact with the center portion of a (horizontal) card without any curl, the end time is the time the lowest end of the convex curved surface of the pressing member 34 returns to the position of coming into contact with the center portion of the card, and the decurl time is set as a time between the start time and the end time. In this Embodiment, the decurl time in one-sided transfer is set at A seconds, and the decurl time in two-sided transfer is set at A' seconds. Herein, A' is in the relationship of $0 \leq A' < A$. FIG. 22B illustrates a state in which the card subjected to the decurl processing as shown in FIG. 22A is rotated 180° (reversed in frontside and backside) with the rotating unit F, an image is transferred to the other surface (lower surface in the figure, e.g. backside) side with the heat roller 33, and the curl of the card is formed in the opposite direction in two-sided transfer. FIG. 22C schematically shows a decurl time in the case where the decurl mechanism 10 performs the decurl processing on one surface (upper side in the figure) of the card to correct the curl of the card as shown in FIG. 22B in the case of two-sided transfer. In this Embodiment, the decurl time is set at B' seconds. Herein, there is the relationship of $0<(A'+B')<A$.

In other words, in the printing apparatus 1 of this Embodiment, the decurl times due to the decurl mechanism 10 in two-sided transfer are set as described below.

(1) The decurl time A' (seconds)) for the other surface in two-sided transfer is smaller (shorter) than the decurl time A (seconds) in one-sided transfer (see FIG. 22A), and (2) the decurl time (A'+B') (seconds) for both surfaces (one surface and the other surface) in two-sided transfer is smaller (shorter) than the decurl time A (seconds) in one-sided transfer (see FIG. 22C).

Figure 22D:
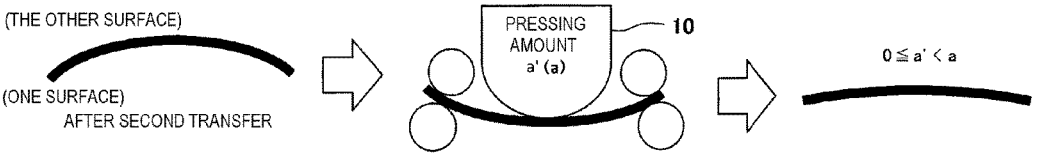
Figure 22E:
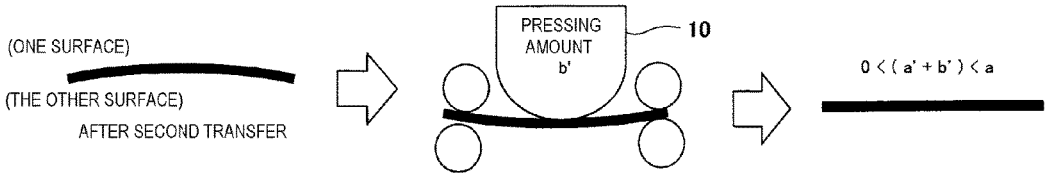

The above-mentioned case is the case of changing the decurl amount (correct amount) by changing the decurl time, and the decurl amount may be changed by changing a pressing amount for the card due to the decurl mechanism 10 (pressing member 34). Herein, the pressing amount originally refers to a distance to a position in which the card is most pressed with reference to a position in which the lowest end of the convex curved surface of the pressing member 34 contacts (comes into contact with) the card, however, since a state of a curl is various corresponding to the type of card and the like and the contact position varies, in this Embodiment, the decurl amount is set as an amount represented by millimeters by which the card is pressed in the direction (lower direction) opposite to the curl of the card with reference to a position in which the lowest end of the convex curved surface of the pressing member 34 comes into contact with a center portion of a (horizontal) card without any curl. FIGS. 22D and 22E illustrate such aspects, and respectively correspond to FIGS. 22A and 22C. This pressing amount is changed by the shape and rotation amount of the eccentric cam 36.

In other words, in the aspects as shown in FIGS. 22D and 22E, the pressing amounts due to the decurl mechanism 10 in two-sided transfer are set as described below.

(3) A pressing amount a' (mm) for the other surface in two-sided transfer is smaller than a pressing amount a (mm) in one-sided transfer (see FIG. 22D), and (4) a pressing amount (a'+b') (mm) for both surfaces (one surface and the other surface) in two-sided transfer is smaller than the pressing amount a (mm) in one-sided transfer (see FIG. 22E).

In addition, as described above, in order to change the decurl amount, the decurl time may be changed, or the pressing amount may be changed, and the decurl time and the pressing amount may be changed respectively. The decurl times A', B' and pressing amounts a', b' are respectively determined corresponding to the type of card and the like as described below.

<Operation>

Next, referring to flowcharts, with respect to card issue operation by the printing apparatus 1 of this Embodiment, control on the decurl mechanism 10 will be described mainly with particular emphasis on the CPU (hereinafter, simply referred to as CPU) of the microcomputer 102. In addition, the description will be given while assuming that each of members constituting the printing apparatus 1 is positioned in a home (initial) position (for example, the state as shown in FIG. 2), initial setting processing for decompressing programs and program data stored in the ROM in the RAM is finished, and that printing data and the like is already received from the higher apparatus 201. In other words, the description will be given while assuming that the CPU receives printing data (printing data of Bk and color component printing data of Y, M, C) and magnetic or electric recording data for one surface (in the case of one-sided printing) or for one surface and the other surface (in the case of two-sided printing) from the higher apparatus 201 to store in the buffer memory 101. Further, the operation of the printing section B (image formation section B1 and transfer section B2) has already been described, and will be briefly described to omit redundancy.

Figure 14:
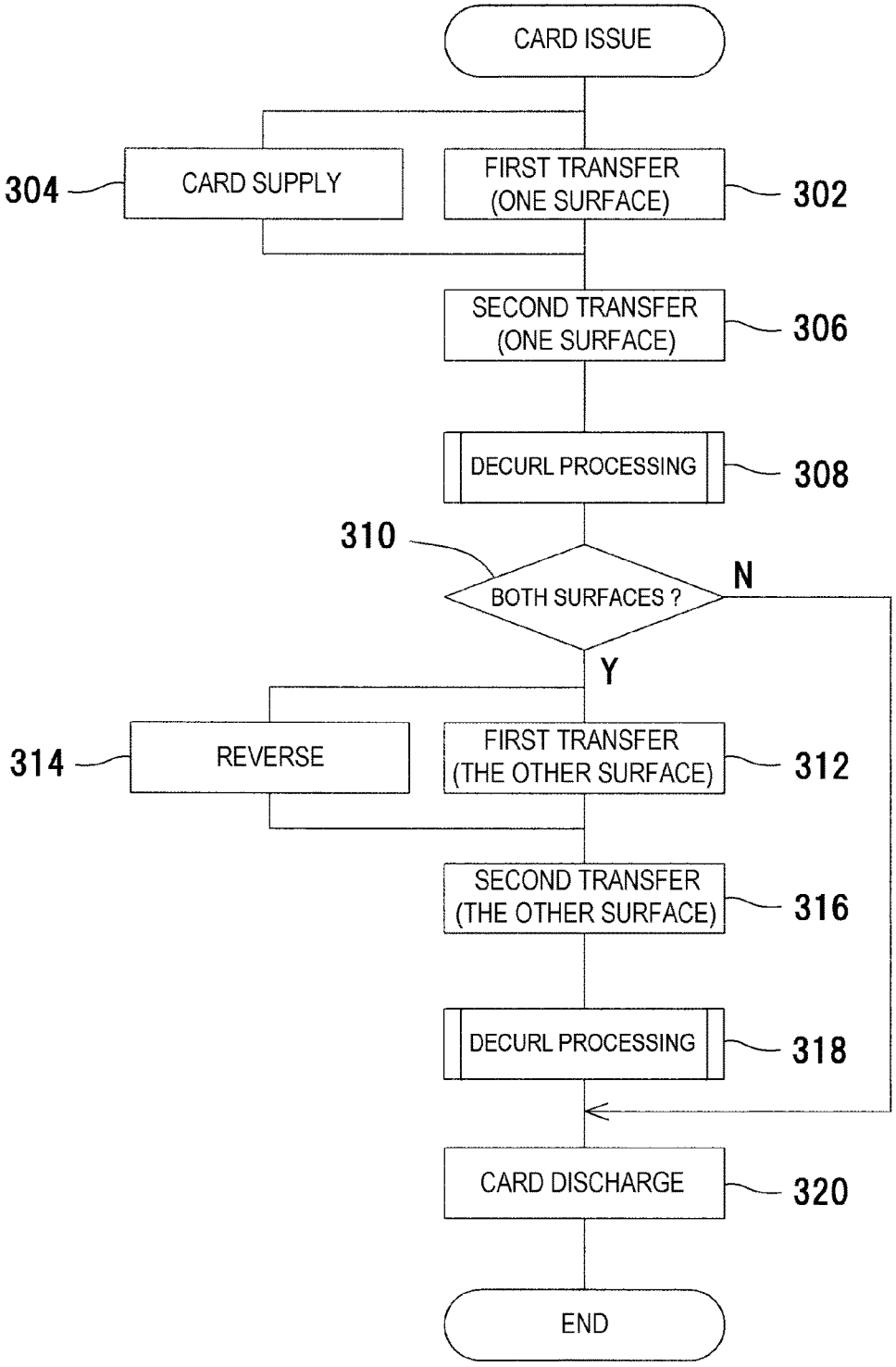
FIG. 14 is a flowchart of a card issue routine executed by a CPU of a microcomputer of the control section in the printing apparatus of the Embodiment.

As shown in FIG. 14, in a card issue routine, in step 302, in the image formation section B1, the CPU performs first transfer processing for forming an image (mirror image) for one surface (for example, frontside) in a predetermined region of the transfer surface of the transfer film 46. In other words, by controlling the thermal head 40 of the image formation section B1 according to the color component printing data of Y, M, C and printing data of Bk stored in the buffer member 101, the CPU forms an image on the transfer film 46 due to Y, M, C and Bk ink of the ink ribbon 41. The CPU outputs the printing data for each line to the thermal head 40 side via the thermal head control section 105, and thereby selectively heats heating elements lined in the main scanning direction to drive the thermal head 40.

In parallel with the first transfer processing in step 302, in step 304, the CPU feeds out a card from the media storage section C, based on the magnetic or electric recording data performs recording processing on the card in a single or a plurality of the magnetic recording section 24, non-contact type IC recording section 23, and contact type IC recording section 27 constituting the information recording section A, and then, transports the card to the transfer section B2.

In next step 306, in the transfer section B2, the CPU performs second transfer processing for transferring the image formed on the transfer surface of the transfer film 46 to one surface of the card. In addition, prior to the second transfer processing, the CPU controls so that the temperature of the heater constituting the heat roller 33 (heat fusing body) reaches a predetermined temperature, while controlling so that the card and the image formed on the transfer surface of the transfer film 46 arrive at the transfer section B2 in synchronization with each other.

Figure 15:
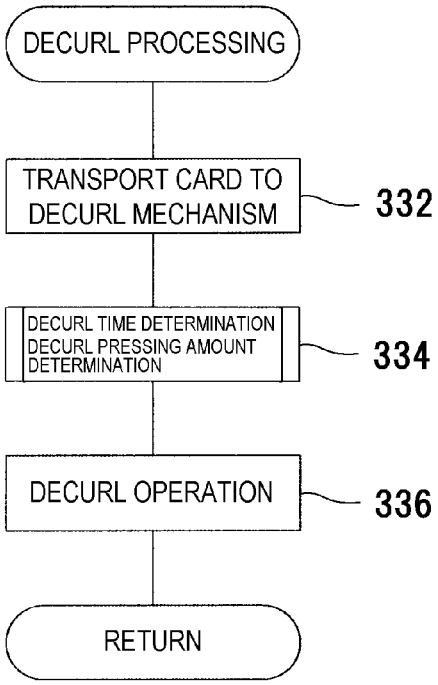
FIG. 15 is a flowchart of a decurl processing subroutine showing details of decurl processing of the card issue routine.
Figure 16:
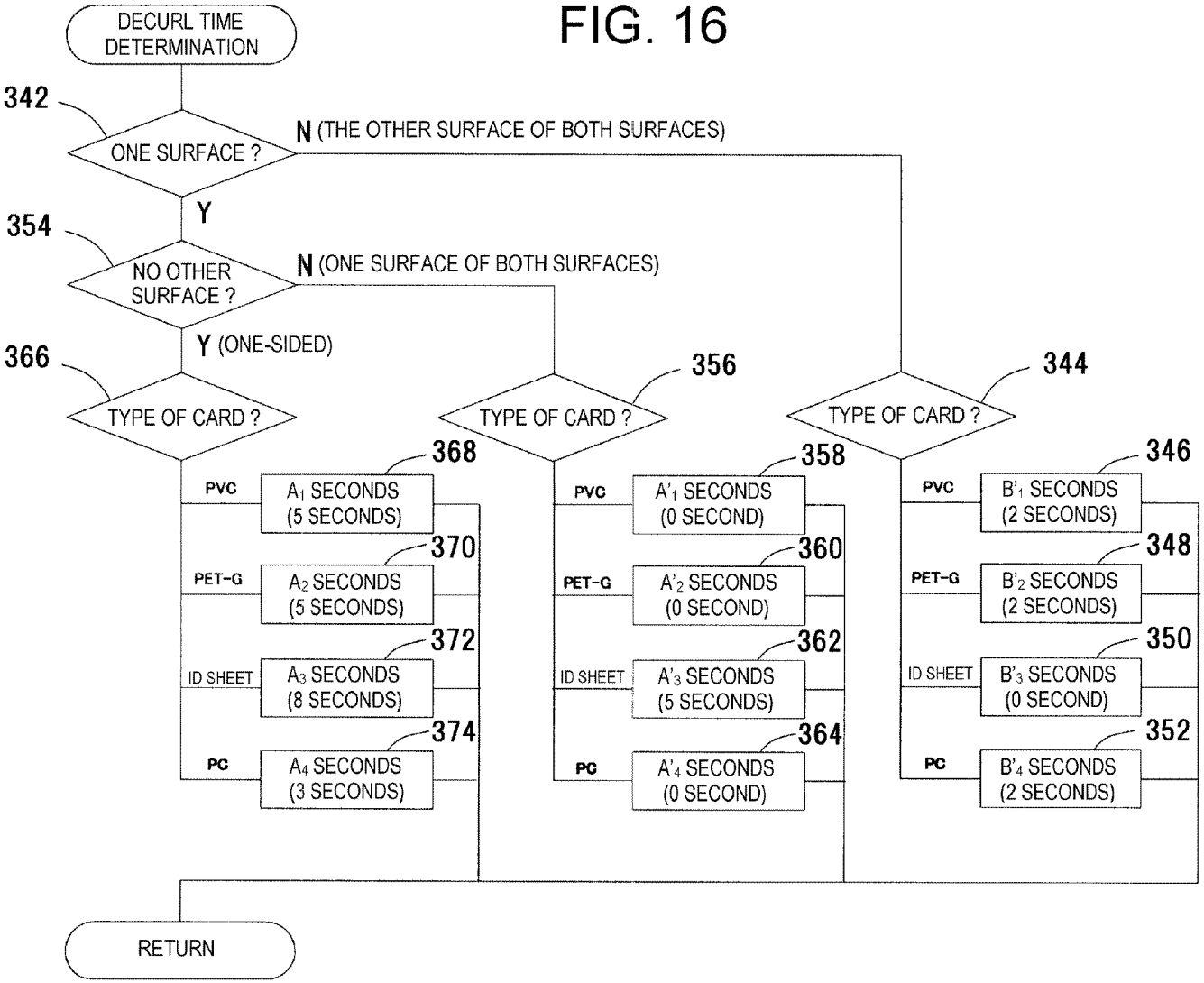
FIG. 16 is a flowchart of a decurl time determination processing subroutine showing details of decurl time determination processing of the decurl processing subroutine.
Figure 17:
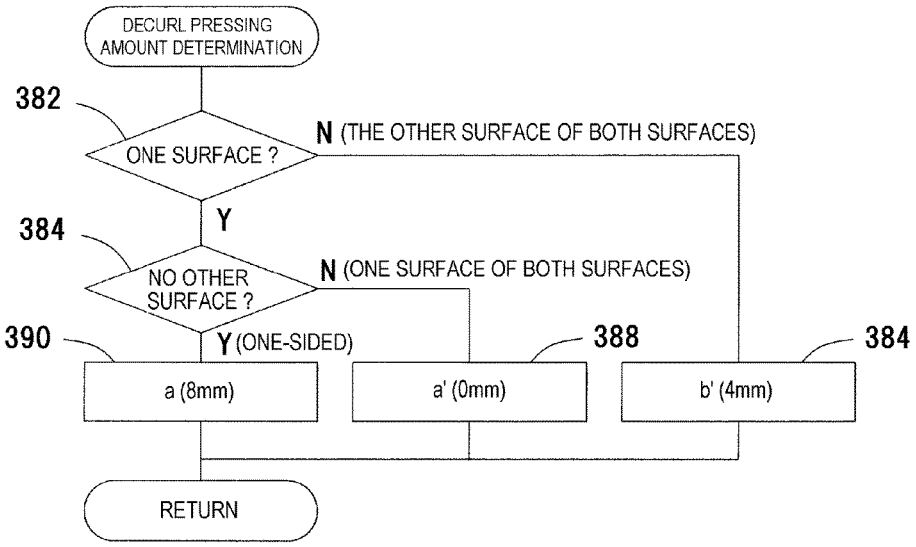
FIG. 17 is a flowchart of a decurl pressing amount determination processing subroutine showing details of decurl pressing mount determination processing of the decurl processing subroutine.

Next, in step 308, the CPU presses the other surface side of the card with the pressing member 34, and thereby executes the decurl processing for correcting a curl of the card (also see FIGS. 22A and 22D). FIG. 15 illustrates a decurl processing subroutine showing details of the decurl processing. In the decurl processing subroutine, first, in step 332, the CPU transports the card with the image transferred to one surface of the card to the decurl mechanism 10. Strictly, the CPU transports the center in the longitudinal direction of the card to a position that corresponds to the lowest end of the curved surface of the pressing member 34. Next, in step 334, the CPU determines the decurl time and decurl pressing amount. FIG. 16 illustrates a decurl time determination processing subroutine, and FIG. 17 illustrates a decurl pressing amount determination subroutine.

As shown in FIG. 16, in the decurl time determination processing subroutine, in step 342 it is judged whether or not the decurl processing is for the case where an image is transferred to one surface of the card, and in a negative judgment (in the decurl processing for the case where an image is transferred to the other surface of the card), in step 344 it is judged that the type or material of the card is PVC, PET-G (polyester resin), peel sheet (peel-capable adhesive sheet) or PC. The decurl time is determined to be $B'_1$ seconds (for example, 2 seconds) in the case of PVC (step 346), is determined to be $B'_2$ seconds (for example, 2 seconds) in the case of PET-G (step 348), is determined to be $B'_3$ seconds (for example, 0 second) in the case of peel sheet (step 350), or is determined to be $B'_4$ seconds (for example, 2 seconds) in the case of PC (step 352), and the processing flow returns to step 334 in FIG. 15. In addition, the type or material information of the card may be beforehand input from the higher apparatus 201 side, or may be input from the operation panel section 5, by a user.

On the other hand, in a positive judgment in step 342, in step 354 it is judged whether or not the decurl processing for the other surface of the card is required, and in a negative judgment (in the decurl processing for the case where an image is transferred to one surface of the card), in step 356 it is judged that the type or material of the card is PVC, PET-G, peel sheet or PC. The decurl time is determined to be $A'_1$ seconds (for example, 0 second) in the case of PVC (step 358), is determined to be $A'_2$ seconds (for example, 0 second) in the case of PET-G (step 360), is determined to be $A'_3$ seconds (for example, 5 seconds) in the case of peel sheet (step 362), or is determined to be $A'_4$ seconds (for example, 0 second) in the case of PC (step 364), and the processing flow returns to step 334 in FIG. 15. In addition, in the case of two-sided transfer, the decurl processing in step 308 in FIG. 14 undergoes the processing of steps 356 to 364.

In a positive judgment in step 354, in step 366 it is judged that the type or material of the card is PVC, PET-G, peel sheet or PC. The decurl time is determined to be $A_1$ seconds (for example, 5 seconds) in the case of PVC (step 368), is determined to be $A_2$ seconds (for example, 5 seconds) in the case of PET-G (step 370), is determined to be $A_3$ seconds (for example, 8 seconds) in the case of peel sheet (step 372), or is determined to be $A_4$ seconds (for example, 3 seconds) in the case of PC (step 374), and the processing flow returns to step 334 in FIG. 15. In addition, in the case of one-sided transfer, the decurl processing in step 308 in FIG. 14 undergoes the processing of steps 366 to 374.

As shown in FIG. 17, in the decurl pressing amount determination subroutine, in step 382 it is judged whether or not the decurl processing is for the case where an image is transferred to one surface of the card. In a negative judgment (in the decurl processing for the case where an image is transferred to the other surface of the card), in step 384 the decurl pressing amount is determined to be b' mm (for example, 4 mm), and the processing flow returns to step 334 in FIG. 15. In a positive judgment, in step 384 it is judged whether or not there is the need for performing the decurl processing for the other surface of the card. In a negative judgment (in the decurl processing for the case where an image is transferred to one surface of the card), in step 388 the decurl pressing amount is determined to be a' mm (for example, 0 mm), and the processing flow returns to step 334 in FIG. 15. When the judgement in step 384 is a positive judgement, in step 390 the decurl pressing amount is determined to be a mm (for example, 8 mm), and the processing flow returns to step 334 in FIG. 15. In addition, in the case of two-sided transfer, the decurl processing in step 308 in FIG. 14 undergoes the processing of step 388, and in the case of one-sided transfer, undergoes the processing of step 390.

In step 310 in FIG. 14, it is judged whether or not transfer is two-sided transfer. In a negative judgment, the processing flow proceeds to step 320. In a positive judgment, in step 312, as in step 302, the image formation section B1 performs the first transfer processing for forming an image (mirror image) for the other surface (for example, backside) in a next predetermined region of the transfer surface of the transfer film 46, and the processing flow proceeds to step 316.

In parallel with the first transfer processing in step 312, in step 314, the CPU transports the card, which is nipped by the transport roller pairs 37, 38 and is positioned in the decurl mechanism 10, to the rotating unit F via the medium transport paths P2, P1, and rotates the card of which opposite end portions are nipped by the roller pairs 20, 21 180° (reverses the frontside and backside). In next step 316, as in step 306, in the transfer section B2, the CPU performs the second transfer processing for transferring the image formed on the transfer film 46 to the other surface of the card (also see FIG. 22B).

Next, in step 318, the CPU presses one surface side of the card with the pressing member 34, and thereby executes the decurl processing for correcting the curl of the card (also see FIGS. 22C and 22E). As in step 308, this decurl processing is executed as in the decurl processing subroutine as shown in FIG. 15, the decurl time determination subroutine as shown in FIG. 16 undergoes the processing of steps 344 to 352, and the decurl pressing amount determination subroutine as shown in FIG. 17 undergoes the processing of step 384.

Then, in next step 320, the CPU discharges the card toward the storage stacker 60, and finishes the card issue routine.

<Effects and Others>

The effects and others of the printing apparatus 1 of this Embodiment will be described next.

In the printing apparatus 1 of this Embodiment, the control section 100 determines so that the decurl amount (correction amount) for the card with a transfer surface transferred to one surface in two-sided transfer is smaller than the decurl amount for the card in one-sided transfer (see FIGS. 22A and 22D). Further, the section 100 determines so that the total sum of correction amounts for respective surfaces of the card in two-sided transfer is smaller than the decurl amount for the card in one-sided transfer (see FIGS. 22C and 22E). Therefore, according to the printing apparatus 1 of this Embodiment, it is possible to efficiently correct a curl of a card-shaped recording medium, and to prevent the recording medium from deteriorating.

Figure 23A:
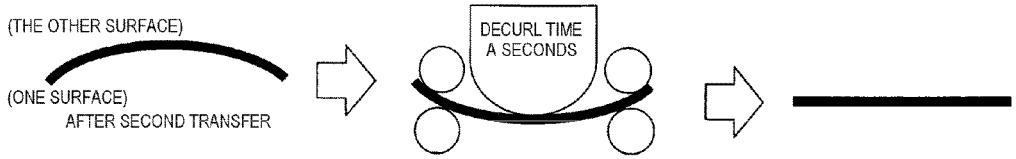
FIGS. 23A to 23F contain explanatory views schematically illustrating conventional decurl operation, where
Figure 23B:
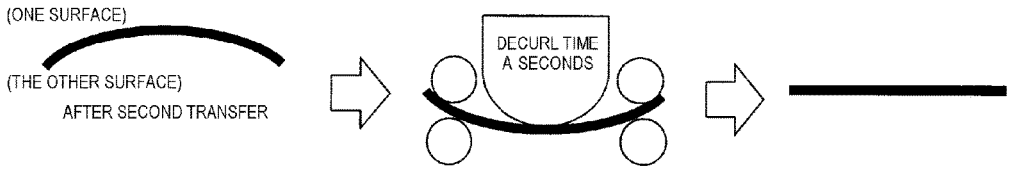
Figure 23C:
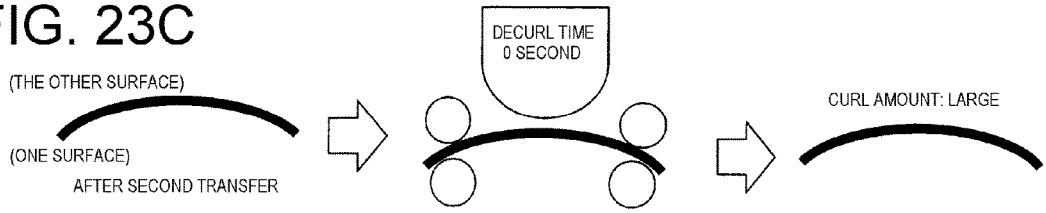
Figure 23D:
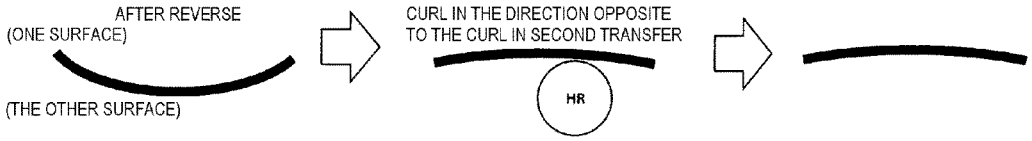
Figure 23E:
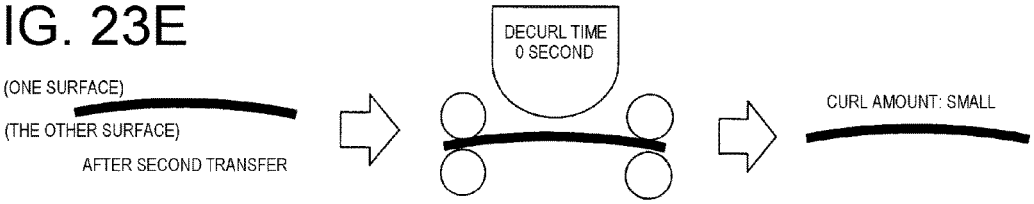
Figure 23F:
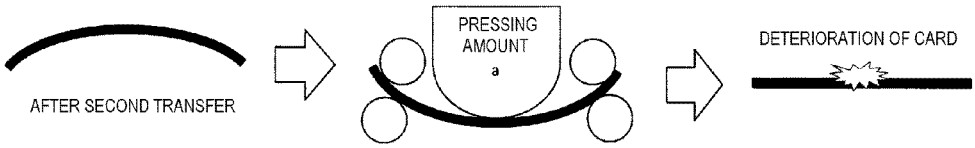

In addition, the above-mentioned Embodiment partially includes the case of not making a correction to a card with an image transferred to one surface of both surfaces in two-sided transfer, and making a correction to a card with an image transferred to the other surface (for example, see A'=0 of step 358 in FIG. 16 and a'=0 in step 388 in FIG. 17), but in principle, is to perform the decurl processing on both surfaces of the card. Herein, as shown in FIG. 23D, in consideration of that apart of the curl of the card is cancelled in two-sided transfer, by setting A'=0 (in addition, B'≠0) and a'=0 (in addition, b'≠0) as shown in FIGS. 22A and 22E and the above-mentioned <Decurl processing>, the need of the decurl processing is eliminated for the card with an image transferred to one surface. Further, contrary thereto, by setting B'=0 (in addition, A'≠0) and b'=0 (in addition, a'≠0), the need of the decurl processing is eliminated for the card with an image transferred to the other surface. In such an aspect, since it is only required to make a correction to the card with an image transferred to the other surface without making a correction to the card with an image transferred to one surface of both surfaces in two-sided transfer, it is possible to correct the curl of the card-shaped recording medium more efficiently, and to prevent the recording medium from deteriorating.

In addition, this Embodiment shows the example of determining the decurl amount (decurl time, pressing amount) corresponding to the type or material of the card, but the present invention is not limited thereto, and the decurl amount may be determined corresponding to an ambient temperature (environmental temperature) detected with the temperature sensor Th, transfer temperature (fusing temperature) of the heat roller 33, transfer velocity of the heat roller 33, a gray-scale level of printing data of an image transferred to the transfer film 46, type of the ink ribbon 41, type of the transfer film 46 or combination thereof.

Figure 18:
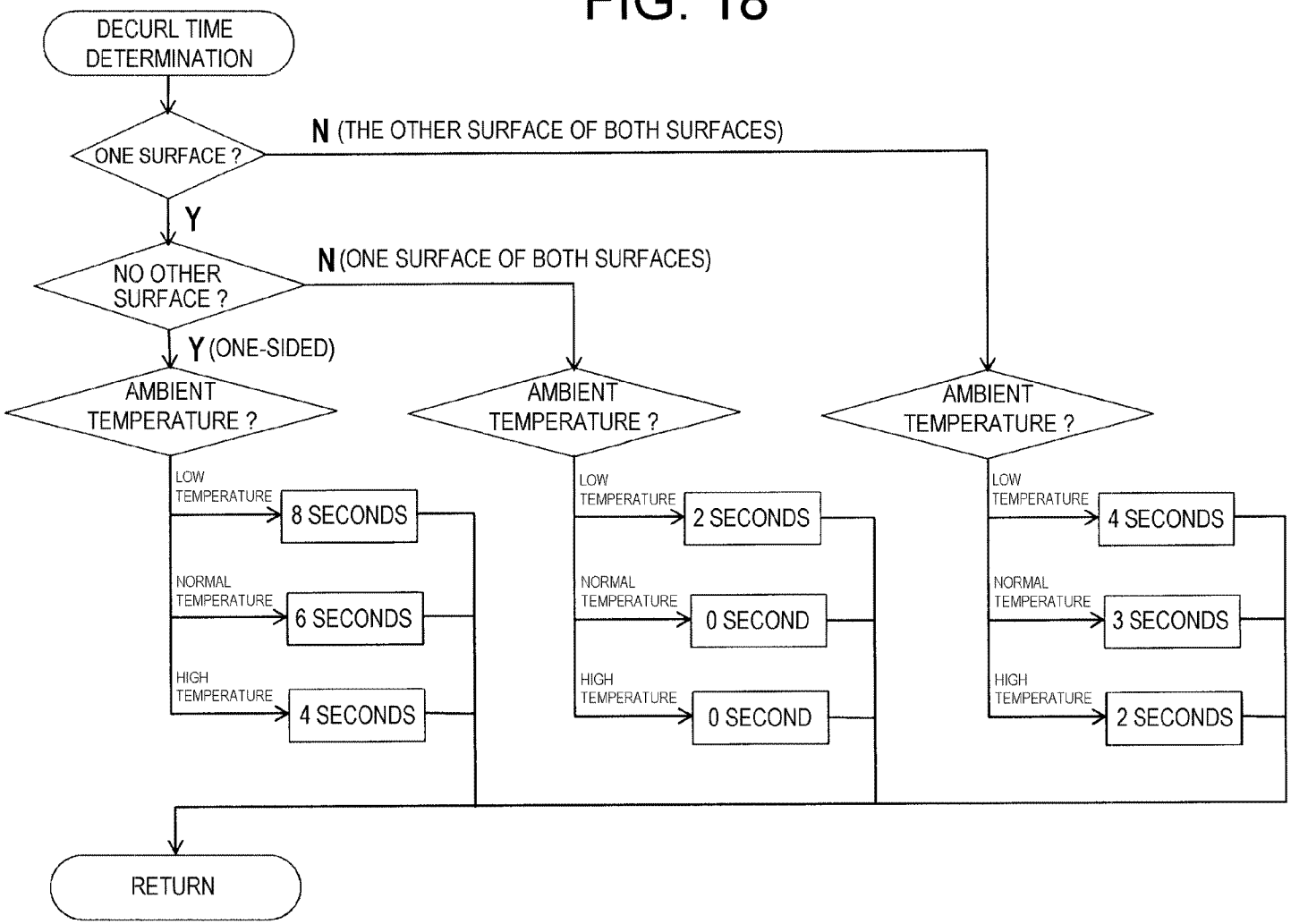
FIG. 18 is a flowchart of a decurl processing subroutine showing details of decurl processing of a card issue routine executed by a CPU of a microcomputer of a control section in a printing apparatus of another Embodiment.

For example, when the ambient temperature is low, since a temperature difference from a card with an image transferred is large, the card tends to curl. Therefore, when the ambient temperature is a low temperature, it is preferable to increase the decurl time. FIG. 18 illustrates an example of determining the decurl time corresponding to the ambient temperature detected with the temperature sensor Th. In FIG. 18, "low temperature" indicates ambient temperatures of 15° C. or less, "normal temperature" indicates ambient temperatures that exceed 15° C. and that are 30° C. or less, and "high temperature" indicates ambient temperatures exceeding 31° C. For example, with respect to a curl occurring in a card in transfer to one surface side in two-sided transfer, in low temperatures, since it is necessary to perform the decurl processing to the extent of not affecting card transport, the decurl time is set at 2 seconds.

Figure 19:
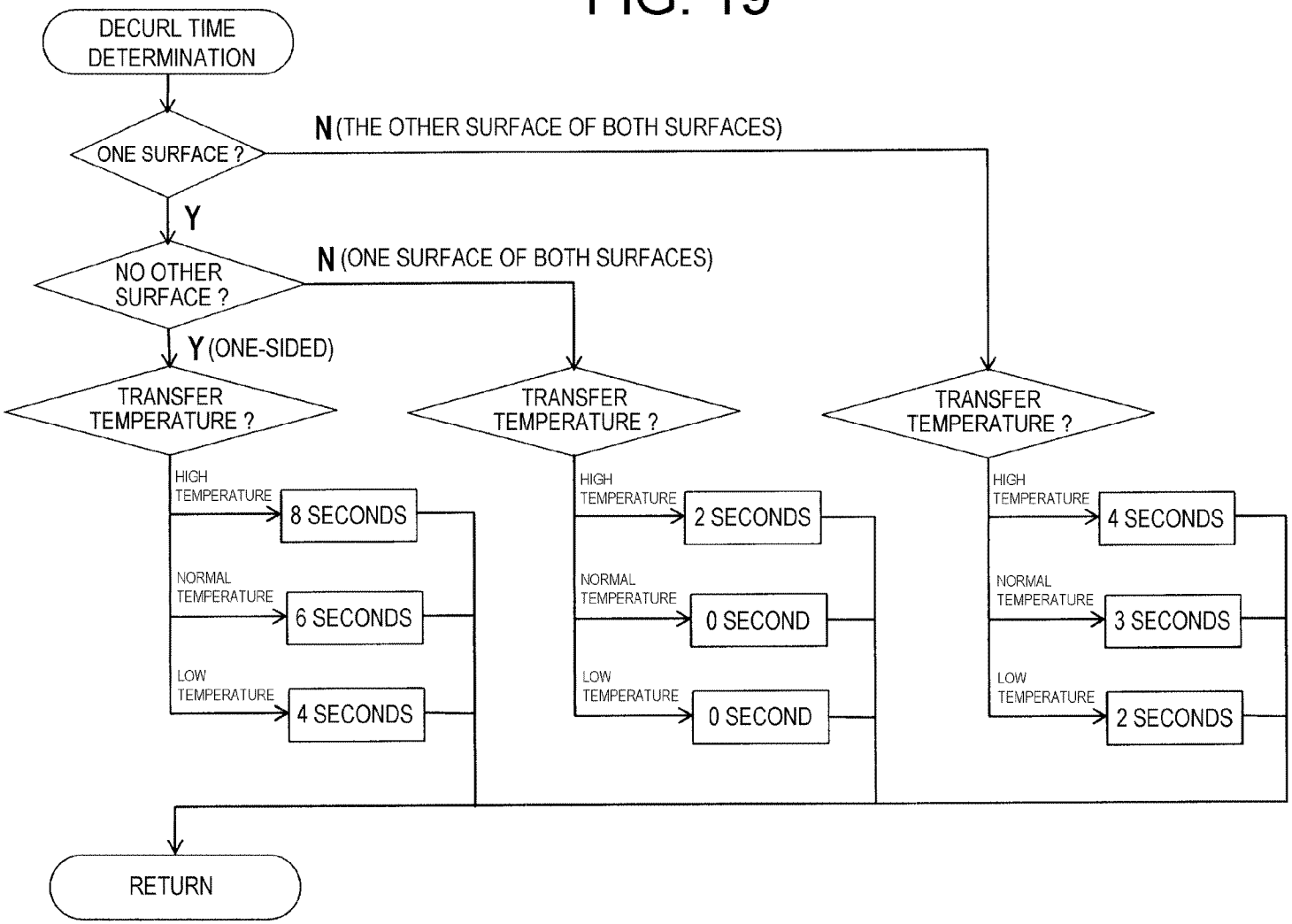
FIG. 19 is a flowchart of a decurl processing subroutine showing details of decurl processing of a card issue routine executed by a CPU of a microcomputer of a control section in a printing apparatus of still another Embodiment.

Further, when the transfer temperature (heat fusing temperature of the heat roller 33) is high, the card tends to curl. Therefore, when the transfer temperature is high, it is preferable to increase the decurl time. FIG. 19 illustrates an example of determining the decurl time corresponding to the transfer temperature of the heat roller 33. In FIG. 19, "low temperature" indicates transfer temperatures of 175° C. or less, "normal temperature" indicates transfer temperatures that exceed 175° C. and that are 185° C. or less, and "high temperature" indicates transfer temperatures exceeding 185° C.

Figure 20:
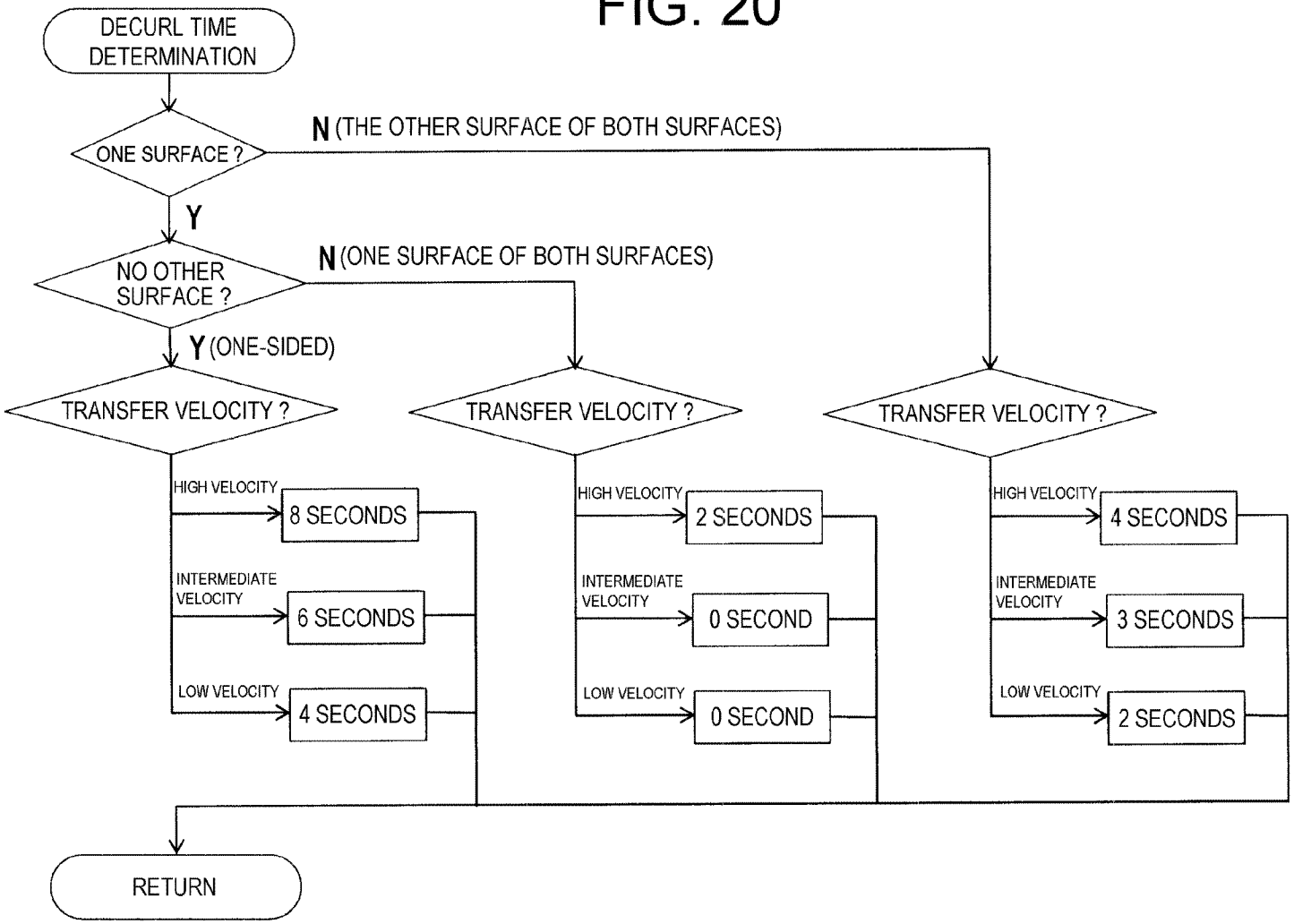
FIG. 20 is a flowchart of a decurl processing subroutine showing details of decurl processing of a card issue routine executed by a CPU of a microcomputer of a control section in a printing apparatus of still another Embodiment.

Furthermore, when the transfer velocity in the transfer section B2 is a low velocity, as compared with the case of high velocity, heat from the heat roller 33 is applied to a card, and the card tends to curl. Therefore, when the transfer velocity is low, it is preferable to increase the decurl time. FIG. 20 illustrates an example of determining the decurl time corresponding to the transfer velocity of the heat roller 33. In FIG. 20, "low velocity" indicates transfer velocities of 15 mm/s or less, "intermediate velocity" indicates transfer velocities that exceed 15 mm/s and that are 30 mm/s or less, and "high velocity" indicates transfer velocities exceeding 45 mm/s. In addition, in the printing apparatus 1 of this Embodiment, it is possible for a user to manually input the transfer temperature and transfer velocity by operating the operation panel section 5, and the apparatus 1 has the configuration for enabling the user to change in using a card or film as well as the types of card and film (ink ribbon 41, transfer film 46) expected to use.

Figure 21:
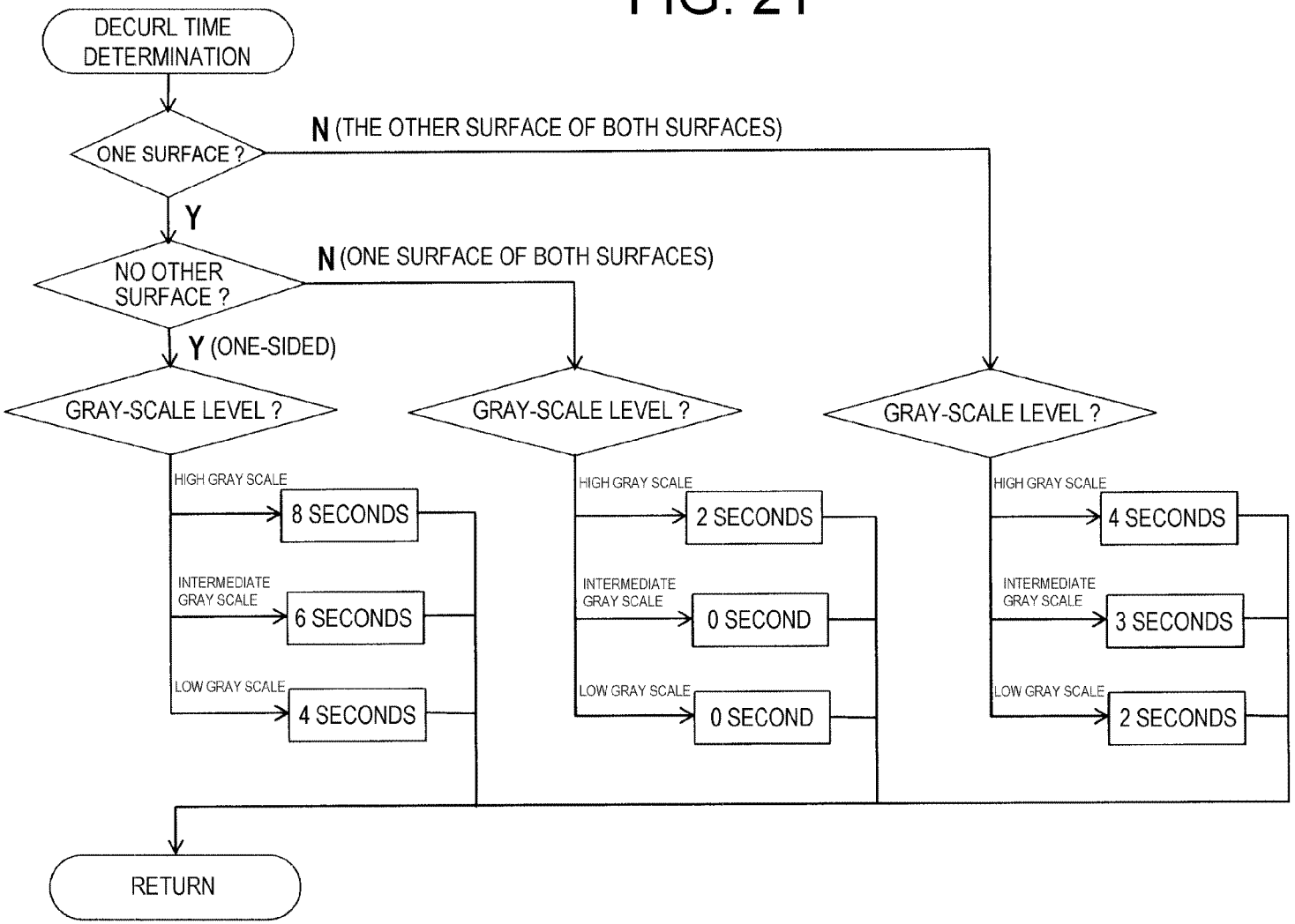
FIG. 21 is a flowchart of a decurl processing subroutine showing details of decurl processing of a card issue routine executed by a CPU of a microcomputer of a control section in a printing apparatus of still another Embodiment.

Still furthermore, also in the case where a transfer image is thick (case of high gray scale), the card tends to curl. Therefore, it is preferable that the decurl time is determined by classifying into high gray scale, intermediate gray scale, and low gray scale. FIG. 21 illustrates an example of determining the decurl time corresponding to an average gray-scale level of pixels constituting the transfer image. For example, calculation of such an average gray-scale level is performed before step 302 in FIG. 14 after storing the printing data in the buffer memory 101. In FIG. 21, "low gray scale" indicates average gray-scale levels of 85 or less, "intermediate gray scale" indicates average gray-scale levels that exceed 85 and that are 170 or less, and "high gray scale" indicates average gray-scale levels (of 256 or less) exceeding 171. In addition, in such an aspect, it is not necessary to limit to the average gray-scale level, and for example, the decurl time may be determined corresponding to the ratio of the number of pixels of high gray scale among the number of pixels constituting the transfer image.

Moreover, the decurl time may be determined corresponding to the type of the ink ribbon 41 or type of the transfer film 46. There is the case where gradation appears (gray scale varies) in a transferred image corresponding to ink materials of Y, M, C, Bk constituting the ink ribbon 41, and further, gradation appears in a transferred image also corresponding to the structure (for example, bulk density) of the ink reception layer constituting the transfer film 46. Such type information may be input from the higher apparatus 201 side or from the operation panel section 5 by the user. Moreover, when the ink ribbon 41 and transfer film 46 are provided with an IC storing type information or circuit (for example, circuit comprised of a resistance with a predetermined resistance value), without the user manually inputting, the control section 100 reads the type information or the resistance value, and is thereby capable of acquiring the type information.

In the case of determining the decurl amount corresponding to a combination of the above-mentioned matters, the determination may be supported as appropriate to correct a curl of a card, for example, by using the decurl time and/or pressing amount with the highest value, or average value among individually obtained decurl times and pressing amounts, performing weighting on individually obtained decurl times and pressing amounts, or the like.

Further, this Embodiment shows the example of determining each of the decurl time and the pressing amount, (see step 334 in FIG. 15), but the present invention is not limited thereto. For example, the decurl amount may be changed by changing the decurl time while making the pressing amount constant, or contrary thereto, the decurl amount may be changed by changing the pressing amount while making the decurl time constant.

Furthermore, this Embodiment shows the decurl mechanism 10 that moves the pressing member 34 to the card side to correct a curl of the card, but the present invention is not limited thereto. For example, the decurl mechanism may be comprised of an immovable rod-shaped member disposed in a higher or lower position than the center portion of the card and perform decurl processing by shifting the transport roller pairs 37, 38 that nip the opposite end portions of the card in the upper or lower direction in FIG. 2.

Still furthermore, this Embodiment exemplifies the ink ribbon 41 in which ribbon panels of Y, M, C, Bk are repeated in a face sequential manner, but the present invention is not limited thereto. For example, a protective layer (OT) may be provided subsequently to Bk. In such an aspect, after forming an image with Y, M, C, Bk, the image formed on the card in the transfer section B2 is coated with the protective layer. Also in this case, a curl of the card occurs, and therefore, it is possible to correct the curl. Instead thereof, the cassette of the transfer film 46 may be replaced with a cassette comprised of a protective film to coat the image formed on the card in the transfer section B2 with the protective film. Also in this case, a curl of the card occurs, and therefore, it is possible to correct the curl.

Moreover, for setting of the decurl time, this Embodiment shows the example of setting at a time between the start time and the end time with the start time set at the time the lowest end of the convex curved surface of the pressing member 34 comes into contact with a (horizontal) card without any curl and the end time set at the time the lowest end of the convex curved surface of the pressing member 34 returns to the position of coming into contact with the center portion of the card. Further, the start time may be set at timing at which the pressing member 34 is positioned in the most pressed position, so that pressing is continued for the set decurl time from the start time, and that the pressing member 34 is shifted to a retracted position after a lapse of the time.

In addition, this application claims priority from Japanese Patent Application No. 2014-106968 incorporated herein by reference.

The invention claimed is:

1. A transfer apparatus comprising:

a transfer section that transfers a transfer surface of a transfer or protective film to one surface or both surfaces of a card-shaped recording medium;

a reverse section that reverses a front side and a backside of the recording medium in two-sided transfer;

a correction section that corrects a curl of the recording medium with the transfer surface transferred in the transfer section; and a control section that controls the correction section, wherein the control section controls the correction section so that a correction amount for the recording medium with the transfer surface firstly transferred to one surface in two-sided transfer is smaller than a correction amount for the recording medium with the transfer surface transferred to one surface in one-sided transfer; and wherein the control section controls the correction section so that respective correction amounts to one and opposite surfaces for the recording medium in two-sided transfer are smaller than the correction amount for the recording medium to the one surface in one-sided transfer.

2. The transfer apparatus according to claim 1, wherein the correction section corrects a curl of the recording medium by pressing a surface on a side opposite to a surface of the recording medium with the transfer surface transferred in the transfer section, and the control section changes the correction amount by changing at least one of time for the correction section to press the surface on the opposite side and a pressing amount against the surface on the opposite side by the correction section.

3. The transfer apparatus according to claim 1, further comprising:

a first acquiring section that acquires type or material information of the recording medium, wherein the control section determines the correction amount corresponding to the type or material information of the recording medium acquired in the first acquiring section.

4. The transfer apparatus according to claim 1, further comprising:

an image formation section that forms an image on the transfer surface of the transfer film via an ink ribbon; and a first acquiring section that acquires image data of the image formed in the image formation section, wherein the control section determines the correction amount corresponding to gray scale of the image data acquired in the first acquiring section.

5. The transfer apparatus according to claim 1, further comprising:

a detection section that detects an environmental temperature, wherein the control section determines the correction amount corresponding to the environmental temperature detected in the detection section.

6. The transfer apparatus according to claim 1, wherein the transfer section has a heat fusing body to heat-fuse the transfer surface of the transfer or protective film to the recording medium, and the control section determines the correction amount corresponding to at least one of a fusing temperature and a fusing velocity of the heat fusing body.

7. The transfer apparatus according to claim 4, further comprising:

a second acquiring section that acquires type information of at least one of the ink ribbon and the transfer film, wherein the control section determines the correction amount corresponding to the type information of at least one of the ink ribbon and the transfer film acquired in the second acquiring section.

8. A transfer apparatus comprising:

a transfer section that transfers a transfer surface of a transfer or protective film to one surface or both surfaces of a card-shaped recording medium;

a reverse section that reverses a frontside and a backside of the recording medium in two-sided transfer;

a correction section that corrects a curl of the recording medium with the transfer surface transferred in the transfer section; and a control section that controls the correction section, wherein the control section controls the correction section so that a correction amount for the recording medium with the transfer surface transferred to one surface in two-sided transfer is smaller than a correction amount for the recording medium in one-sided transfer, and the control section controls the correction section so that a total sum of correction amounts for respective surfaces of the recording medium in two-sided transfer is smaller than the correction amount for the recording medium in one-sided transfer.

9. A transfer apparatus comprising:

a transfer section that transfers a transfer surface of a transfer or protective film to one surface or both surfaces of a card-shaped recording medium;

a reverse section that reverses a frontside and a backside of the recording medium in two-sided transfer;

a correction section that corrects a curl of the recording medium with the transfer surface transferred in the transfer section; and a control section that controls the correction section, wherein the control section controls the correction section so that a correction amount for the recording medium with the transfer surface firstly transferred to a surface in two-sided transfer is smaller than a correction amount for the recording medium with the transfer surface transferred to a first surface in one-sided transfer, and wherein the control section controls the correction section so that the correction section does not make a correction to the recording medium with the transfer surface firstly transferred to a first surface in two-sided transfer, while making a correction to only the recording medium with the transfer surface transferred to a second surface in two-sided transfer, and that a correction amount for the recording medium with the transfer surface transferred to the second surface in two-sided transfer is smaller than a correction amount for the recording medium with the transfer surface transferred to the first surface in one-sided transfer.

10. The transfer apparatus according to claim 9, wherein the correction section corrects a curl of the recording medium by pressing a surface on a side opposite to a surface of the recording medium with the transfer surface transferred in the transfer section, and the control section changes the correction amount by changing at least one of time for the correction section to press the surface on the opposite side and a pressing amount against the surface on the opposite side by the correction section.

11. The transfer apparatus according to claim 9, further comprising:

a first acquiring section that acquires type or material information of the recording medium, wherein the control section determines the correction amount corresponding to the type or material information of the recording medium acquired in the first acquiring section.

12. The transfer apparatus according to claim 9, further comprising:

an image formation section that forms an image on the transfer surface of the transfer film via an ink ribbon; and a first acquiring section that acquires image data of the image formed in the image formation section, wherein the control section determines the correction amount corresponding to gray scale of the image data acquired in the first acquiring section.

13. The transfer apparatus according to claim 9, further comprising:

a detection section that detects an environmental temperature, wherein the control section determines the correction amount corresponding to the environmental temperature detected in the detection section.

14. The transfer apparatus according to claim 9, wherein the transfer section has a heat fusing body to heat-fuse the transfer surface of the transfer or protective film to the recording medium, and the control section determines the correction amount corresponding to at least one of a fusing temperature and a fusing velocity of the heat fusing body.

* * * * *